US011508304B2

(12) United States Patent
Liu et al.

(10) Patent No.: US 11,508,304 B2
(45) Date of Patent: Nov. 22, 2022

(54) DISPLAY PANEL, METHOD FOR DRIVING THE DISPLAY PANEL AND DISPLAY DEVICE

(71) Applicant: SeeYa Optronics, Ltd., Shanghai (CN)

(72) Inventors: Ping-Lin Liu, Shanghai (CN); Tong Wu, Shanghai (CN)

(73) Assignee: SeeYa Optronics Co., Ltd., Shanghai (CN)

( * ) Notice: Subject to any disclaimer, the term of this patent is extended or adjusted under 35 U.S.C. 154(b) by 0 days.

(21) Appl. No.: 17/592,484

(22) Filed: Feb. 3, 2022

(65) Prior Publication Data

US 2022/0246097 A1 Aug. 4, 2022

(30) Foreign Application Priority Data

Feb. 4, 2021 (CN) ..... 202110150453.2

(51) Int. Cl.
*G09G 3/3233* (2016.01)

(52) U.S. Cl.
CPC ... *G09G 3/3233* (2013.01); *G09G 2300/0842* (2013.01); *G09G 2310/061* (2013.01); *G09G 2310/08* (2013.01); *G09G 2320/0233* (2013.01)

(58) Field of Classification Search
CPC ..... G09G 3/3233; G09G 2300/0842; G09G 2310/061; G09G 2310/08; G09G 2320/0233
See application file for complete search history.

(56) References Cited

U.S. PATENT DOCUMENTS 10,431,153 B2 * 10/2019 Gao ..... G09G 3/3225
2017/0110054 A1 * 4/2017 Sun ..... G09G 3/3258
2019/0259336 A1 * 8/2019 Miyasaka ..... G09G 3/3291
2019/0348491 A1 * 11/2019 Chung ..... H01L 27/3279
(Continued)

FOREIGN PATENT DOCUMENTS

CN 102903333 A 1/2013
CN 103971640 A 8/2014
(Continued)

OTHER PUBLICATIONS

Chinese Office Action dated Mar. 22, 2021 in connection with Chinese Application No. 202110150453.2.
(Continued)

*Primary Examiner* — Jeff Piziali
(74) *Attorney, Agent, or Firm* — Wolf, Greenfield & Sacks, P.C.

(57) ABSTRACT

Provided is a display panel. The display panel includes a substrate, a plurality of sub-pixels and at least one multi-voltage supply circuit; where each of the plurality of sub-pixels includes a pixel circuit and a light-emitting element; and the pixel circuit includes an initialization circuit, a data writing circuit, a drive circuit, a threshold compensation circuit, a first light-emission control circuit and a storage circuit; where the first light-emission control circuit controls the drive circuit to generate a drive current which flows into the light-emitting element in a light emission stage; and the at least one multivoltage supply circuit supplies a reset signal to a first terminal of the storage circuit in the initialization stage and a first stage and supplies a first power signal to the first terminal of the storage circuit in a second stage.

20 Claims, 15 Drawing Sheets

(56) References Cited

U.S. PATENT DOCUMENTS

| | | | | |
|---|---|---|---|---|
| 2020/0006446 | A1* | 1/2020 | Lee | H01L 27/3225 |
| 2020/0035164 | A1* | 1/2020 | Qing | G09G 3/3266 |
| 2022/0101780 | A1* | 3/2022 | Xiao | G09G 3/32 |

FOREIGN PATENT DOCUMENTS

| | | | |
|---|---|---|---|
| CN | 105405397 | A | 3/2016 |
| CN | 106558287 | A | 4/2017 |
| CN | 107103878 | A | 8/2017 |
| CN | 107170408 | A | 9/2017 |
| KR | 101515481 | B1 | 5/2015 |
| TW | I254269 | B | 5/2006 |

OTHER PUBLICATIONS

Chinese Office Action dated Apr. 9, 2021 in connection with Chinese Application No. 202110150453.2.

* cited by examiner

DISPLAY PANEL, METHOD FOR DRIVING THE DISPLAY PANEL AND DISPLAY DEVICE

CROSS-REFERENCE TO RELATED APPLICATION

This application claims priority to Chinese Patent Application No. 202110150453.2 filed Feb. 4, 2021, the disclosure of which is incorporated herein by reference in its entirety.

TECHNICAL FIELD

Embodiments of the present disclosure relate to the field of display technology and, in particular, to a display panel, a method for driving the display panel and a display device.

BACKGROUND

An organic light-emitting diode (OLED) display has become the most potential display at present due to the advantages of self-luminescence, low drive voltage, high luminescence efficiency, short response time, flexible display and the like.

An OLED element of the OLED display is a current driven element. A corresponding pixel circuit needs to be disposed to provide a drive current for the OLED element so that the OLED element can emit light. The pixel circuit of the OLED display typically includes a drive transistor, a storage capacitor and the like, where the drive transistor can generate the drive current for driving the OLED element according to the voltage of a gate of the drive transistor. However, for reasons such as the manufacturing process and the aging of devices, the drive transistors in different pixel circuits have different threshold voltages, resulting in non-uniform display.

SUMMARY

Embodiments of the present disclosure provide a display panel, a method for driving the display panel and a display device, so as to solve the problem where drive transistors in different pixel circuits have different threshold voltages for reasons such as the manufacturing process and the aging of devices, resulting in non-uniform display.

In a first aspect, embodiments of the present disclosure provide a display panel. The display panel includes a substrate, a plurality of sub-pixels and at least one multivoltage supply circuit.

The plurality of sub-pixels are arranged on a side of the substrate, each of the plurality of sub-pixels includes a pixel circuit and a light-emitting element; and the pixel circuit includes an initialization circuit, a data writing circuit, a drive circuit, a threshold compensation circuit, a first light-emission control circuit and a storage circuit; and A first terminal of the storage circuit is electrically connected to the multivoltage supply circuit and a second terminal of the storage circuit is electrically connected to a control terminal of the drive circuit.

The initialization circuit is configured to supply an initialization signal to the control terminal of the drive circuit and an anode of the light-emitting element in an initialization stage.

The data writing circuit is configured to transmit a data signal to the control terminal of the drive circuit in a data writing stage.

The threshold compensation circuit is configured to provide a threshold voltage of the drive circuit as a compensation to the control terminal of the drive circuit.

The storage circuit is configured to store the data signal transmitted to the control terminal of the drive circuit.

The first light-emission control circuit is configured to control the drive circuit to generate a driving current which flows into the light-emitting element to drive the light-emitting element to emit light in a light emission stage.

The data writing stage includes a first stage and a second stage.

The multivoltage supply circuit is configured to supply a reset signal to the first terminal of the storage circuit in the initialization stage and the first stage and supply a first power signal to the first terminal of the storage circuit in the second stage such that a signal at the second terminal of the storage circuit varies, where a voltage variation is a difference between the first power signal and the reset signal.

In a second aspect, embodiments of the present disclosure further provide a method for driving a display panel. The method for driving a display panel is applied to the display panel described in the first aspect and includes steps described below.

In an initialization stage, an initialization circuit supplies an initialization signal to a control terminal of a drive circuit and an anode of a light-emitting element, and a multivoltage supply circuit supplies a reset signal to a first terminal of a storage circuit.

In a first stage, a data writing circuit transmits a data signal to the control terminal of the drive circuit, a threshold compensation circuit provides a threshold voltage of the drive circuit as a compensation to the control terminal of the drive circuit, and the multivoltage supply circuit supplies the reset signal to the first terminal of the storage circuit.

In a second stage, the multivoltage supply circuit supplies a first power signal to the first terminal of the storage circuit such that a signal at a second terminal of the storage circuit varies, where a voltage variation is a difference between the first power signal and the reset signal.

At a light emission stage, a first light-emission control circuit controls the drive circuit to generate a drive current which flows into the light-emitting element to drive the light-emitting element to emit light.

In a third aspect, embodiments of the present disclosure further provide a display device. The display device includes the display panel described in the first aspect.

In the display panel, the method for driving the display panel and the display device provided by the embodiments of the present disclosure, a storage capacitor and the threshold compensation circuit are provided for the threshold compensation of the drive circuit, which can reduce display non-uniformity due to the fluctuation of threshold voltages of drive circuits in sub-pixels and improve the display effect of the display panel. Additionally, the pixel circuit provided by the embodiment of the present disclosure has a simple structure and can have a relatively small size, which is conducive to improving the resolution of the display panel. Additionally, the multivoltage supply circuit is provided so that the voltage of the control terminal of the drive circuit varies. Therefore, to enable the light-emitting element to maintain the original brightness, a larger voltage needs to be inputted so that compared with an existing sub-pixel, a data range of the sub-pixel expands and a voltage for a grayscale of 0-255 of the sub-pixel can be clearly adjusted.

DETAILED DESCRIPTION

Figure 1:
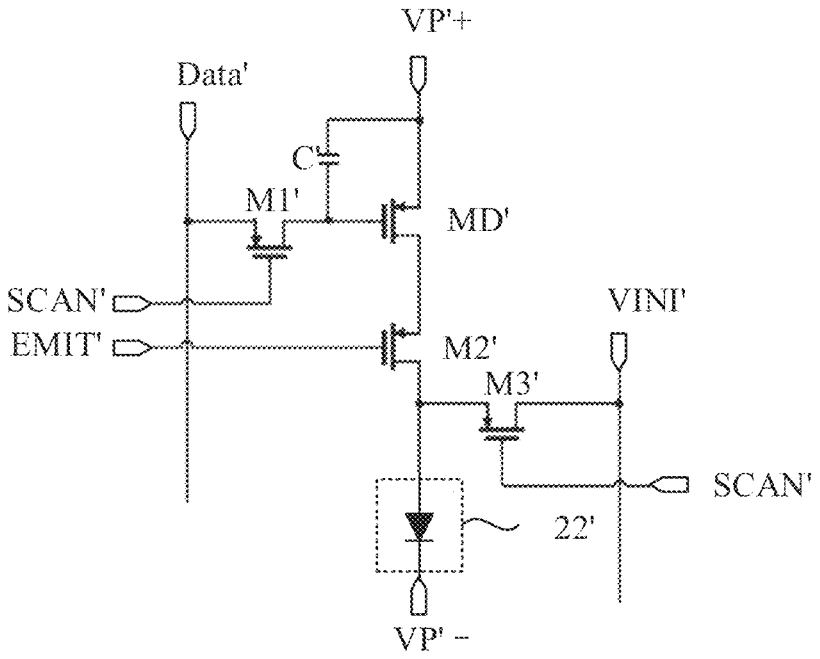
FIG. 1 is a structure diagram of a pixel circuit in a related art.

The present disclosure is further described hereinafter in detail in conjunction with drawings and embodiments. It is to be understood that the embodiments described herein are merely intended to explain the present disclosure and not to limit the present disclosure. Additionally, it is to be noted that for ease of description, only part, not all, of the structures related to the present disclosure are illustrated in the drawings.

FIG. 1 is a structure diagram of a pixel circuit in a related art. As shown in FIG. 1, the pixel circuit in the related art includes a drive transistor MD', a data writing transistor M1', a light-emission control transistor M2', an initialization transistor M3' and a storage capacitor C'. In a data writing stage, a scan signal inputted from a scan signal terminal SCAN' controls the data writing transistor M1' and the initialization transistor M3' to be turned on so that a data signal transmitted from a data signal terminal Data' is written into a gate of the drive transistor MD' through the data writing transistor M1' that is turned on, and an initialization signal transmitted from an initialization signal terminal VINI' is written into an anode of a light-emitting element 22' through the initialization transistor M3' that is turned on so as to reset the anode of the light-emitting element 22'. In a light emission stage, a light-emission control signal inputted from a light-emission control terminal EMIT' controls the light-emission control transistor M2' to be turned on, a drive current generated by the drive transistor MD' flows into the light-emitting element 22', and the light-emitting element 22' emits light in response to the drive current. It is to be noted that a first power terminal VP'+ electrically connected to a terminal of the drive transistor MD' is configured to receive a first power signal, and a second power terminal VP'− electrically connected to a cathode of the light-emitting element 22' is configured to receive a second power signal.

Based on an OLED-On-Silicon display panel, since a p-type metal-oxide-semiconductor (PMOS) transistor has a large mobility and a grayscale current of a pixel is at a pA to nA level, the drive transistor MD' is working in a sub-threshold region in the light emission stage, where a sub-threshold current is expressed by Formula (1):

$$I_{MD} = \frac{Z}{L}\mu_p\left(\frac{kT}{q}\right)^2 C_D(\varphi_s)\exp\left[\frac{q}{kT}\left(\frac{V_{GS}-V_{th}}{n}\right)\right]\times\left[1-\exp\left(-\frac{qV_{DS}}{kT}\right)\right] \quad (1)$$

where k denotes a Boltzmann constant, T denotes an absolute temperature, q denotes a charge of an electron, $$\frac{Z}{L}$$

denotes a width-to-length ratio of the drive transistor MD', $C_D$ ($\varphi_s$) denotes a capacitance of a potential barrier of a channel depletion region of the drive transistor MD', $V_{th}$ denotes the threshold voltage, $V_{GS}$ denotes a gate-source voltage of the drive transistor MD', $V_{DS}$ denotes a drain-source voltage of the drive transistor MD', and $I_{MD}$ denotes the drive current.

Figure 2:
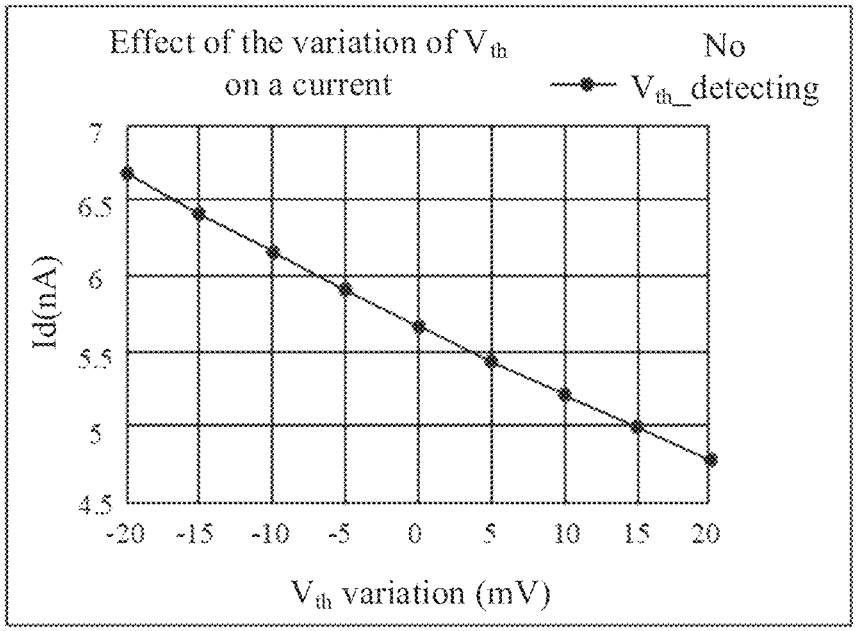
FIG. 2 is a schematic diagram of a correspondence between a threshold voltage and a drive current of a pixel circuit in the related art.
Figure 3:
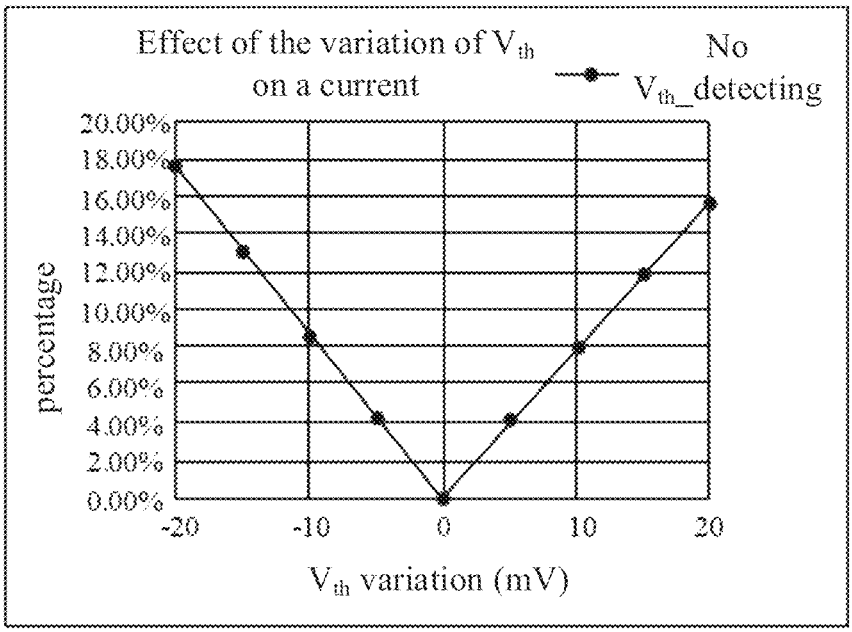
FIG. 3 is a schematic diagram of a correspondence between a threshold voltage and a percentage by which a drive current varies of a pixel circuit in the related art.

As can be seen from Formula (1), the drive current $I_{MD}$ is sensitive to the threshold voltage $V_{th}$ of the drive transistor MD' and the drive current $I_{MD}$ is directly related to the threshold voltage $V_{th}$. Therefore, when sub-pixels have different threshold voltages $V_{th}$ for reasons such as the manufacturing process and the aging of devices, the drive current $I_{MD}$ may also vary, resulting in uncontrollable gamma and non-uniform display. FIG. 2 is a schematic diagram of a correspondence between a threshold voltage and a drive current of a pixel circuit in the related art, and FIG. 3 is a schematic diagram of a correspondence between a threshold voltage and a percentage by which a drive current varies of a pixel circuit in the related art. In FIG. 2, the abscissa denotes a variation of the threshold voltage and the ordinate denotes the drive current. As can be seen from FIG. 2, when the variation of the threshold voltage $V_{th}$ is within ±20 mV, the drive current fluctuates between 6.7 nA and 4.8 nA. In FIG. 3, the abscissa denotes the variation of the threshold voltage and the ordinate denotes a percentage by which the drive current varies. As can be seen from FIG.

3, when the variation of the threshold voltage $V_{th}$ is within ±20 mV, the drive current fluctuates within a range of 18%. That is, as can be seen from FIGS. 2 and 3, in the pixel circuit in the related art, the drive current fluctuates within a very large range as the threshold voltage varies so that display brightness fluctuates very significantly, affecting the display effect.

However, in the related art, a pixel circuit having a threshold compensation function has a complex structure and a relatively large size, which is not conducive to the high resolution of a display panel.

To solve the preceding technical problem, an embodiment of the present disclosure provides a display panel. The display panel includes a substrate, a plurality of sub-pixels and at least one multivoltage supply circuit. The plurality of sub-pixels are arranged on a side of the substrate, each of the plurality of sub-pixels includes a pixel circuit and a light-emitting element, and the pixel circuit includes an initialization circuit, a data writing circuit, a drive circuit, a threshold compensation circuit, a first light-emission control circuit and a storage circuit; where a first terminal of the storage circuit is electrically connected to the multivoltage supply circuit and a second terminal of the storage circuit is electrically connected to a control terminal of the drive circuit; the initialization circuit is configured to supply an initialization signal to the control terminal of the drive circuit and an anode of the light-emitting element in an initialization stage; the data writing circuit is configured to transmit a data signal to the control terminal of the drive circuit in a data writing stage; the threshold compensation circuit is configured to provide a threshold voltage of the drive circuit as a compensation to the control terminal of the drive circuit; the storage circuit is configured to store the data signal transmitted to the control terminal of the drive circuit; the first light-emission control circuit is configured to control the drive circuit to generate a drive current which flows into the light-emitting element to drive the light-emitting element to emit light in a light emission stage. The data writing stage includes a first stage and a second stage. The multivoltage supply circuit is configured to supply a reset signal to the first terminal of the storage circuit in the initialization stage and the first stage and supply a first power signal to the first terminal of the storage circuit in the second stage such that a signal at the second terminal of the storage circuit varies, where a voltage variation is a difference between the first power signal and the reset signal.

According to the preceding technical solutions, a storage capacitor and the threshold compensation circuit are provided for the threshold compensation of the drive circuit, which can reduce display non-uniformity due to the fluctuation of threshold voltages of the drive circuits in pixels and improve the display effect of the display panel. Additionally, the pixel circuit provided by the embodiment of the present disclosure has a simple structure and can have a relatively small size, which is conducive to improving the resolution of the display panel. Additionally, the multivoltage supply circuit is provided so that the voltage of the control terminal of the drive circuit varies. Therefore, to enable the light-emitting element to maintain the original brightness, a larger voltage needs to be inputted so that compared with an existing sub-pixel, a data range of the sub-pixel expands and a voltage for a grayscale of 0-255 of the sub-pixel can be clearly adjusted.

The preceding is the core idea of the present disclosure. Based on the embodiments of the present disclosure, all other embodiments obtained by those having ordinary skill in the art without creative work are within the scope of the present disclosure. The technical solutions in the embodiments of the present disclosure are described clearly and completely in conjunction with the drawings in the embodiments of the present disclosure.

Figure 4:
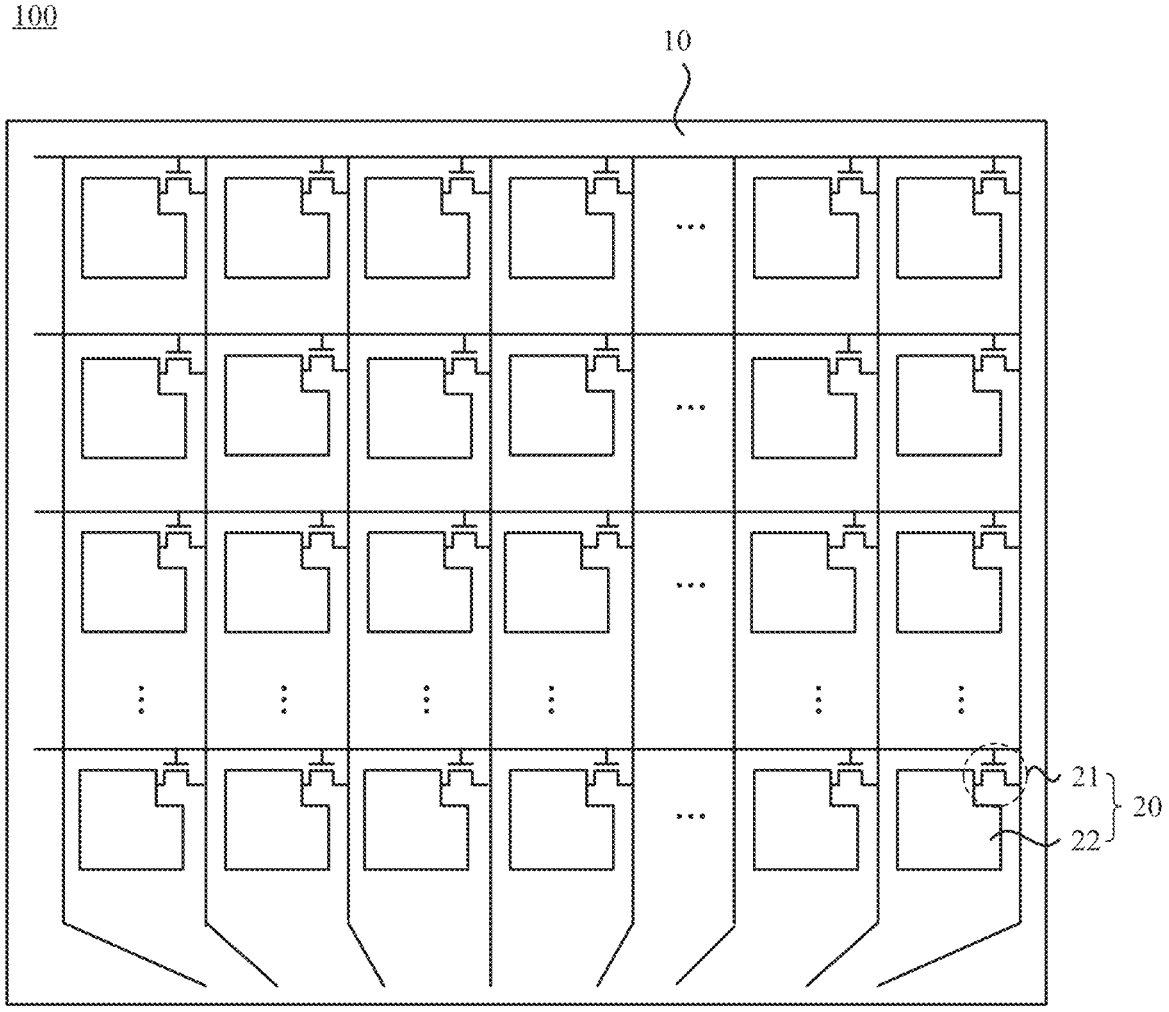
FIG. 4 is a structure diagram of a display panel according to an embodiment of the present disclosure.
Figure 5:
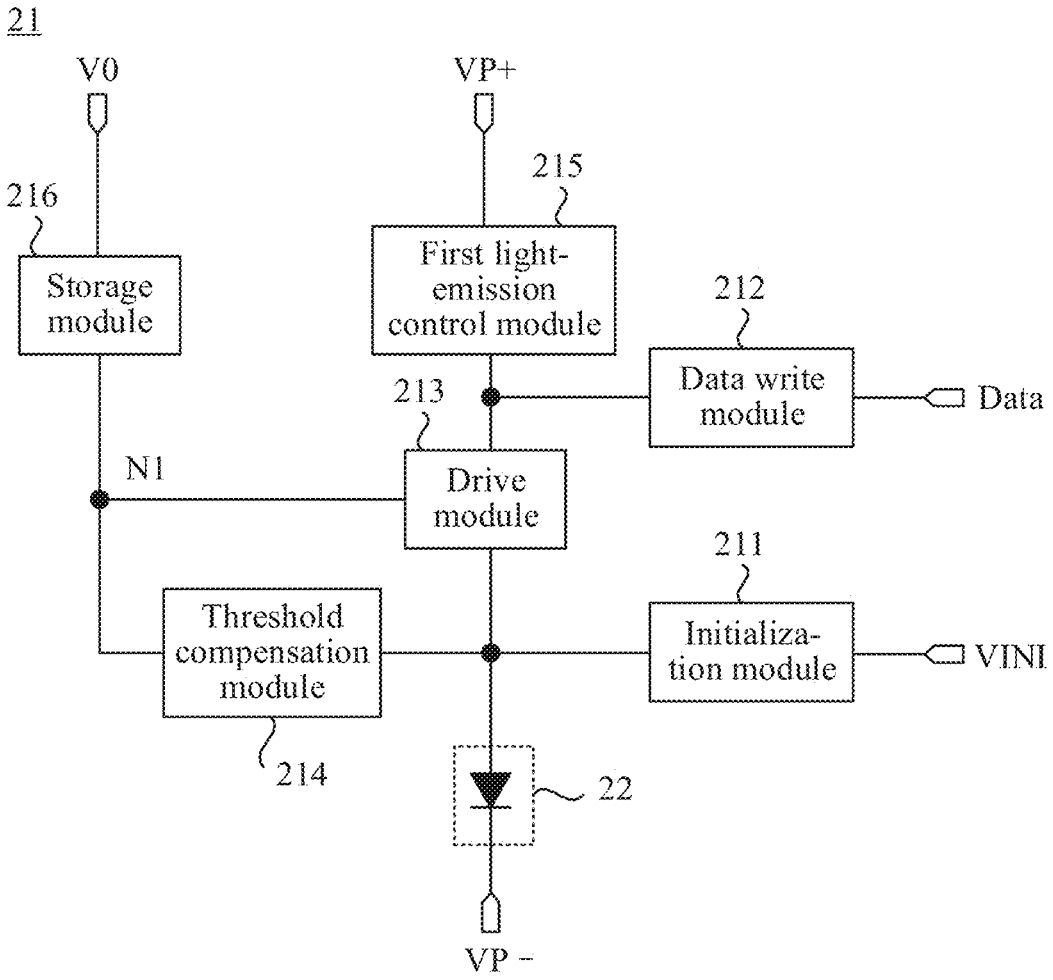
FIG. 5 is a structure diagram of a pixel circuit in FIG. 4.

FIG. 4 is a structure diagram of a display panel according to an embodiment of the present disclosure, and FIG. 5 is a structure diagram of a pixel circuit in FIG. 4. As shown in FIGS. 4 and 5, a display panel 100 provided by the embodiment of the present disclosure includes a substrate 10 and a plurality of sub-pixels 20 arranged on a side of the substrate 10, where each sub-pixel 20 includes a pixel circuit 21 and a light-emitting element 22, and the pixel circuit 21 includes an initialization circuit 211, a data writing circuit 212, a drive circuit 213, a threshold compensation circuit 214, a first light-emission control circuit 215 and a storage circuit 216; where the initialization circuit 211 is configured to supply an initialization signal to a control terminal of the drive circuit 213 and an anode of the light-emitting element 22 in an initialization stage; the data writing circuit 212 is configured to transmit a data signal to the control terminal of the drive circuit 213 in a data writing stage; the threshold compensation circuit 214 is configured to provide a threshold voltage of the drive circuit 213 as a compensation to the control terminal of the drive circuit 213; the storage circuit 216 is configured to store the data signal transmitted to the control terminal of the drive circuit 213; and the first light-emission control circuit 215 is configured to control the drive circuit 213 to generate a drive current which flows into the light-emitting element 22 to drive the light-emitting element 22 to emit light in a light emission stage.

In an embodiment, in the initialization stage, the initialization circuit 211 and the threshold compensation circuit 214 are turned on, and the initialization circuit 211 supplies the initialization signal $V_{ini}$ to the anode of the light-emitting element 22 to initialize a potential of the anode of the light-emitting element 22, so as to reduce an effect of a voltage of the anode of the light-emitting element 22 in a previous frame on a voltage of the anode of the light-emitting element 22 in the current frame and improve display uniformity; and the initialization circuit 211 provides the initialization signal $V_{ini}$ to the control terminal N1 of the drive circuit 213 through the threshold compensation circuit 214 to initialize the drive circuit 213, so as to avoid an effect of a data signal for light emission and display in the previous frame on a potential of the control terminal N1 of the drive circuit 213 in the current frame and prevent the display effect of the current frame from being affected. That is, the anode of the light-emitting element 22 and the control terminal N1 of the drive circuit 213 can be initialized by the initialization circuit 211, which is simple in structure.

In the data writing stage, the data writing circuit 212 and the threshold compensation circuit 214 are turned on, and the data signal $V_{data}$ supplied by the data writing circuit 212 can be written into the control terminal N1 of the drive circuit 213 through the data writing circuit 212 and the threshold compensation circuit 214 so that the voltage of the control terminal N1 of the drive circuit 213 gradually increases until a difference between the voltage of the control terminal N1 of the drive circuit 213 and a voltage of a first terminal of the drive circuit 213 is equal to the threshold voltage $V_{th}$ of the drive circuit 213. At this time, the drive circuit 213 is turned off, and the voltage of the control terminal N1 of the drive circuit 213 is $V1=V_{data}-V_{th}$, where $V_{th}$ denotes the threshold voltage of the drive circuit. In this case, a voltage difference Vc between two terminals of the storage circuit 216 is $Vc=V0-V2=V0-(V_{data}-V_{th})$, where V0 denotes a potential of a first terminal of the storage circuit 216 and may be, for example, a fixed potential, and V2 denotes a potential of a second terminal of the storage circuit 216. That is, in the data writing stage, the threshold voltage $V_{th}$ of the drive circuit 213 is detected and stored on the storage circuit 216.

In the light emission stage, the first light-emission control circuit 215 is turned on and transmits a first power signal VP+ to one terminal of the drive circuit 213. At this time, a voltage difference between the first terminal and the control terminal N1 of the drive circuit 213 is $V3=(VP+)-(V_{data}-V_{th})=(VP+)-V_{data}+V_{th}$, and the drive circuit 213 generates the drive current which flows into the light-emitting element 22 and drives the light-emitting element 22 to emit light. In this case, in Formula (1) of the drive current, $|V_{GS}-V_{th}|=(VP+)-V_{data}+V_{th}-V_{th}=(VP+)-V_{data}$, that is, the formula of the drive current is expressed as:

$$I_{MD} = K \times \exp\left[\frac{q}{kT}\left(\frac{VP+ - V_{data}}{n}\right)\right] \times \left[1 - \exp\left(-\frac{qV_{DS}}{kT}\right)\right] \quad (2)$$

where $$K = \frac{Z}{L}\mu_p\left(\frac{kT}{q}\right)^2 C_D(\varphi_s),$$

Figure 6:
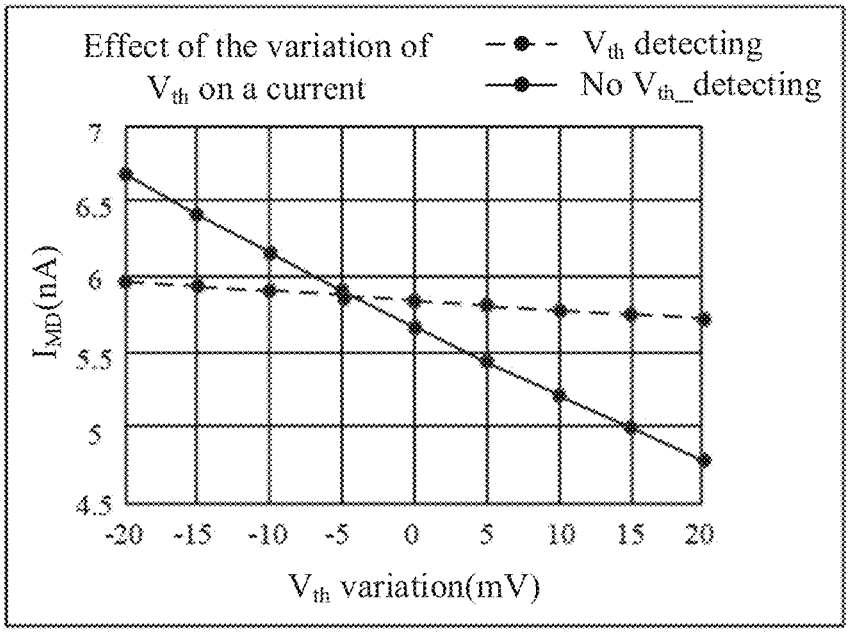
FIG. 6 is a diagram illustrating the comparison between a correspondence between a threshold voltage and a drive current of a pixel circuit according to an embodiment of the present disclosure and a correspondence between a threshold voltage and a drive current of a pixel circuit in the related art.
Figure 7:
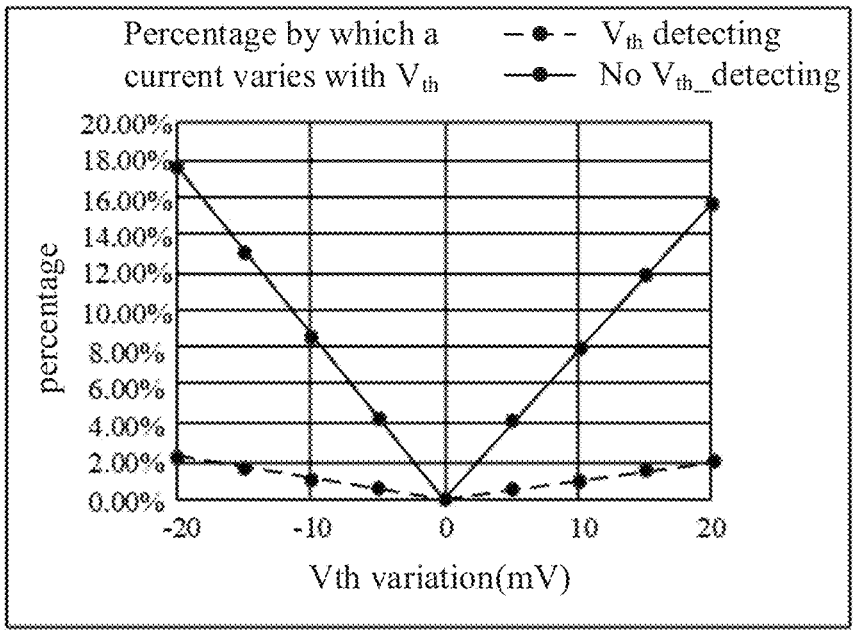
FIG. 7 is a diagram illustrating the comparison between a correspondence between a threshold voltage and a percentage by which a drive current varies of a pixel circuit according to an embodiment of the present disclosure and a correspondence between a threshold voltage and a percentage by which a drive current varies of a pixel circuit in the related art.

$\varphi_{FB}<\varphi_S<2\varphi_{FB}$, and $\varphi_S$ in $C_D(\varphi_s)$ may be $$1.5\varphi_{FB}.\frac{Z}{L}$$

denotes a width-to-length ratio of the drive circuit 213, $C_D(\varphi_s)$ denotes a capacitance of a potential barrier of a channel depletion region of the drive circuit 213, $V_{th}$ denotes the threshold voltage, $V_{DS}$ denotes a drain-source voltage of the drive circuit 213, and $I_{MD}$ denotes the drive current. As can be seen from Formula (2), the drive current $I_{MD}$ generated by the drive circuit 213 is independent of the threshold voltage $V_{th}$ of the drive circuit 213. Therefore, the compensation for the threshold voltage of the drive circuit 213 is achieved, and the following problem in the related art is solved: when sub-pixels have different threshold voltages $V_{th}$ for reasons such as the manufacturing process and the aging of devices, the drive current $I_{MD}$ may also vary, resulting in uncontrollable gamma and non-uniform display. FIG. 6 is a diagram illustrating the comparison between a correspondence between a threshold voltage and a drive current of a pixel circuit according to an embodiment of the present disclosure and a correspondence between a threshold voltage and a drive current of a pixel circuit in the related art. FIG. 7 is a diagram illustrating the comparison between a correspondence between a threshold voltage and a percentage by which a drive current varies of a pixel circuit according to an embodiment of the present disclosure and a correspondence between a threshold voltage and a percentage by which a drive current varies of a pixel circuit in the related art. In FIG. 6, the abscissa denotes a variation of the threshold voltage and the ordinate denotes the drive current. As can be seen from FIG. 6, when the variation of the threshold voltage $V_{th}$ is within ±20 mV, the drive current is almost unvaried if the pixel circuit provided in this embodiment is used. In FIG. 7, the abscissa denotes the variation of the threshold voltage and the ordinate denotes the percentage by which the drive current varies. As can be seen from FIG. 7, when the variation of the threshold voltage $V_{th}$ is within ±20 mV, the drive current fluctuates within a range of 2% if the pixel circuit provided in this embodiment is used. As can be seen from FIGS. 6 and 7, the pixel circuit provided in this embodiment is insensitive to the threshold voltage $V_{th}$ of the drive circuit 213, and when the variation of the threshold voltage $V_{th}$ is within ±20 mV, the drive current is almost unvaried so that the display effect of the display panel is not affected by the variation of the threshold voltage $V_{th}$ and a more stable visual effect is achieved.

It is to be noted that one terminal of the initialization circuit 211 is electrically connected to, for example, an initialization signal terminal VINI which is configured to receive the initialization signal $V_{ini}$, one terminal of the data writing circuit 212 is electrically connected to, for example, a data signal terminal Data which is configured to receive the data signal $V_{data}$, and a second power terminal electrically connected to a cathode of the light-emitting element 22 is configured to receive a second power signal VP−.

It is to be noted that the specific structures of the initialization circuit 211, the data writing circuit 212, the drive circuit 213, the threshold compensation circuit 214, the first light-emission control circuit 215 and the storage circuit 216 are not specifically limited in the embodiments of the present disclosure. On the premise that the compensation function of the threshold voltage of the drive circuit 213 can be implemented, the circuits of the pixel circuit may be designed according to actual requirements.

To conclude, in the display panel provided by the embodiment of the present disclosure, a storage capacitor and the threshold compensation circuit are provided for the threshold compensation of the drive circuit, which can reduce display non-uniformity due to the fluctuation of threshold voltages of the drive circuits in sub-pixels and improve the display effect of the display panel. Additionally, the pixel circuit provided by the embodiment of the present disclosure has a simple structure and can have a relatively small size, which is conducive to improving the resolution of the display panel.

Optionally, the substrate 10 includes a silicon-based substrate. That is, the pixel circuit and the like are prepared on single-crystal silicon using a complementary metal-oxide-semiconductor (CMOS) technique. Since the pixel circuit 21 provided by the embodiment of the present disclosure has a simple structure and a relatively small size, the pixel circuit, even when applied to a silicon-based display panel, can ensure the high resolution of the silicon-based display panel.

Figure 8:
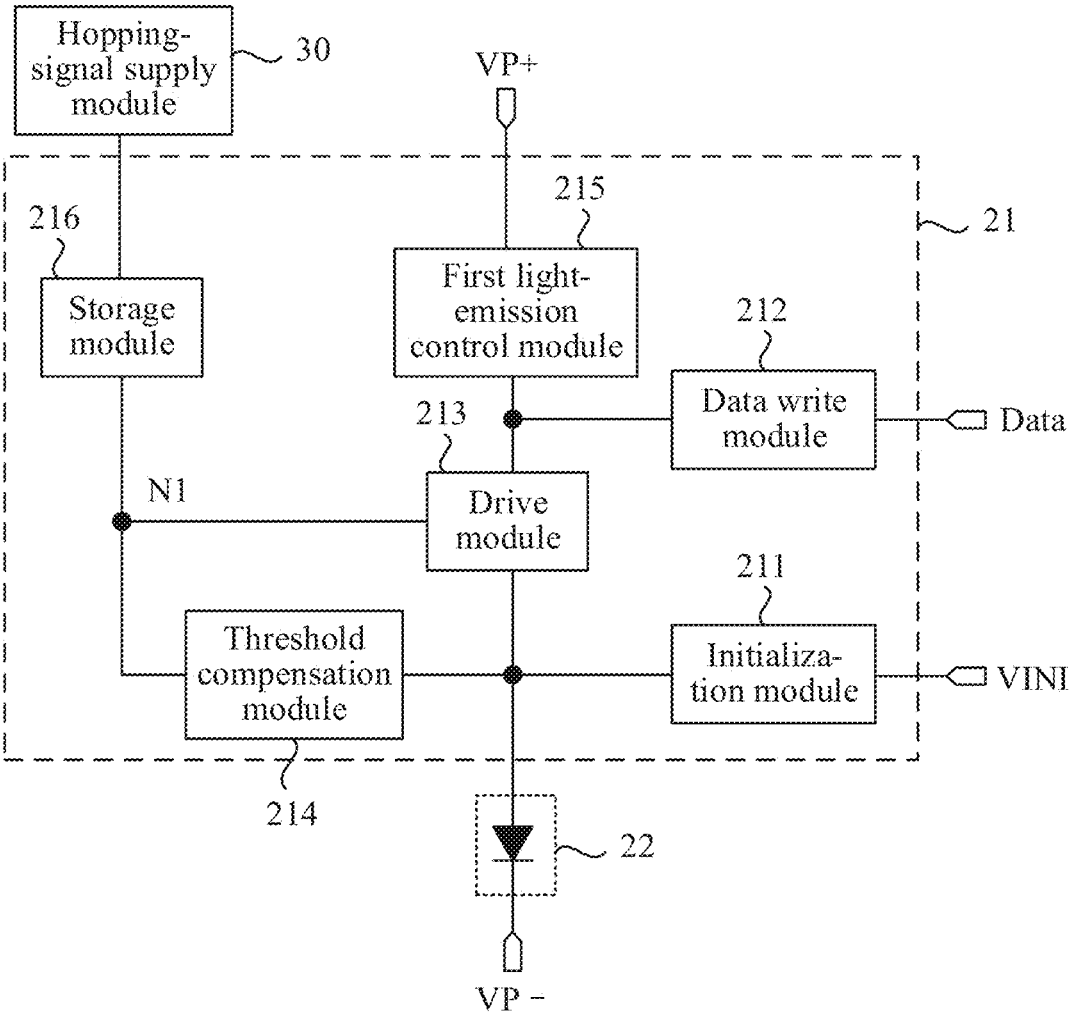
FIG. 8 is a partial structure diagram of a display panel according to an embodiment of the present disclosure.

Optionally, FIG. 8 is a partial structure diagram of a display panel according to an embodiment of the present disclosure. As shown in FIG. 8, the display panel 100 provided by the embodiment of the present disclosure further includes at least one multivoltage supply circuit 30, where the first terminal of the storage circuit 216 is electrically connected to the multivoltage supply circuit 30 and the second terminal of the storage circuit 216 is electrically connected to the control terminal N1 of the drive circuit 213. The data writing stage includes a first stage and a second stage. The multivoltage supply circuit 30 is configured to supply a reset signal $V_{ref}$ to the first terminal of the storage circuit 216 in the initialization stage and the first stage and supply the first power signal VP+ to the first terminal of the storage circuit 216 in the second stage such that a signal at the second terminal of the storage circuit 216 varies, where a voltage variation is a difference between the first power signal VP+ and the reset signal $V_{ref}$.

The principle of the technical solution is described below by using an example in which the drive circuit 213 is the PMOS transistor and the storage circuit 216 is the storage capacitor.

For example, in the initialization stage, the initialization circuit 211 and the threshold compensation circuit 214 are turned on, and the initialization circuit 211 supplies the initialization signal $V_{ini}$ to the anode of the light-emitting element 22; and the initialization circuit 211 supplies the initialization signal $V_{ini}$ to the control terminal N1 of the drive circuit 213 through the threshold compensation circuit 214 to initialize the drive circuit 213. In this case, the potential of the control terminal N1 of the drive circuit 213 is $V_{ini}+V_{th}$, that is, the potential of the second terminal of the storage circuit 216 is $V_{ini}+V_{th}$. Meanwhile, the multivoltage supply circuit 30 provides the reset signal $V_{ref}$ to the first terminal of the storage circuit 216. In this case, the voltage difference between the two terminals of the storage circuit 216 is $V_{ref}-(V_{ini}+V_{th})$.

In the first stage, the data writing circuit 212 and the threshold compensation circuit 214 are turned on, and the data signal $V_{data}$ supplied by the data writing circuit 212 can be written into the control terminal N1 of the drive circuit 213 through the data writing circuit 212 and the threshold compensation circuit 214 so that the voltage of the control terminal N1 of the drive circuit 213 gradually increases until the difference between the voltage of the control terminal N1 of the drive circuit 213 and the voltage of the first terminal of the drive circuit 213 is equal to the threshold voltage $V_{th}$ of the drive circuit 213. At this time, the drive circuit 213 is turned off, and the voltage of the control terminal N1 of the drive circuit 213 is $V1=V_{data}-V_{th}$, that is, the potential of the second terminal of the storage circuit 216 is $V_{data}$ $V_{th}$. Meanwhile, the multivoltage supply circuit 30 supplies the reset signal $V_{ref}$ to the first terminal of the storage circuit 216. In this case, the voltage difference between the two terminals of the storage circuit 216 is $V_{ref}-(V_{data}-V_{th})$.

In the second stage, the initialization circuit 211, the data writing circuit 212, the threshold compensation circuit 214 and the first light-emission control circuit 215 are all turned off. The multivoltage supply circuit 30 supplies the first power signal VP+ to the first terminal of the storage circuit 216 so that the potential of the first terminal of the storage circuit 216 jumps from the reset signal $V_{ref}$ to the first power signal VP+, that is, a voltage jump ΔV is generated, where $\Delta V=(VP+)-V_{ref}$.

Since a capacitor has the characteristic of charge conservation, if a potential of one plate of the storage capacitor varies, a potential of the other plate of the storage capacitor can be varied accordingly by the coupling action. Therefore, when the first terminal of the storage circuit 216 generates the voltage jump ΔV, the second terminal of the storage circuit 216 also generates the voltage jump ΔV, that is, the control terminal N1 of the drive circuit 213 generates the voltage jump ΔV. The final potential of the control terminal N1 of the drive circuit 213 is $(VP+)-V_{ref}+V_{data}-V_{th}$.

In the light emission stage, the first light-emission control circuit 215 is turned on and transmits the first power signal VP+ to one terminal of the drive circuit 213. At this time, the voltage difference between the first terminal and the control terminal N1 of the drive circuit 213 is $V3=(VP+)-((VP+)-V_{ref}+V_{data}-V_{th})=V_{ref}-V_{data}+V_{th}$, and the drive circuit 213 generates the drive current which flows into the light-emitting element 22 and drives the light-emitting element 22 to emit light. In this case, in Formula (1) of the drive current, $|V_{GS}-V_{th}|=V_{ref}-V_{data}+V_{th}-V_{th}=V_{ref}-V_{data}$, that is, the formula of the drive current is expressed as:

$$I_{MD} = K \times \exp\left[\frac{q}{kT}\left(\frac{V_{ref} - V_{data}}{n}\right)\right] \times \left[1 - \exp\left(-\frac{q^{V_{DS}}}{kT}\right)\right] \quad (3)$$

Figure 9:
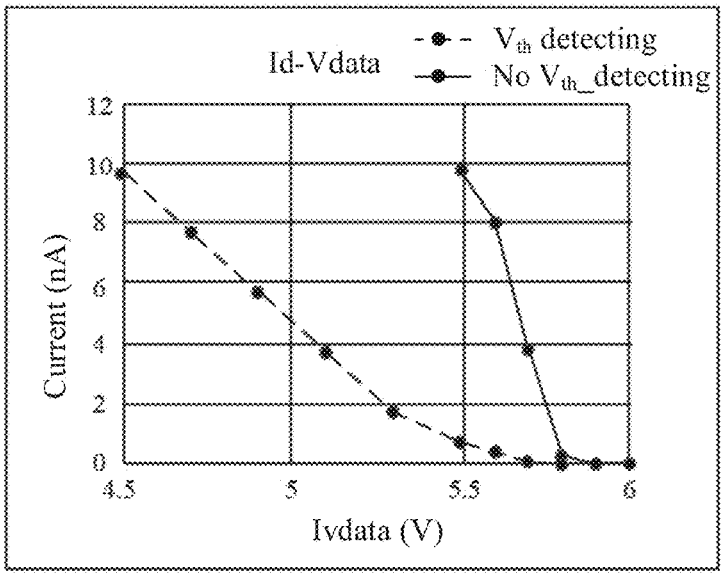
FIG. 9 is a diagram illustrating the comparison between a correspondence between a data voltage and a drive current of a pixel circuit according to an embodiment of the present disclosure and a correspondence between a data voltage and a drive current of a pixel circuit in the related art.

It can be seen that the drive current $I_{MD}$ generated by the drive circuit 213 is independent of the threshold voltage $V_{th}$ of the drive circuit 213 and VP+, that is, the display panel in this embodiment not only has the function of compensating the threshold voltage but also can avoid an effect of a voltage drop, resulting in more uniform display. Additionally, the multivoltage supply circuit is provided so that the voltage of the control terminal N1 of the drive circuit 213 varies. Therefore, to enable the light-emitting element 22 to maintain the original brightness, the larger voltage needs to be inputted so that compared with a sub-pixel in a related art, a data range of the sub-pixel expands and a voltage for a grayscale of 0-255 of the sub-pixel can be easily adjusted. FIG. 9 is a diagram illustrating the comparison between a correspondence between a data voltage and a drive current of a pixel circuit according to an embodiment of the present disclosure and a correspondence between a data voltage and a drive current of a pixel circuit in the related art. As shown in FIG. 9, the pixel circuit in the related art has a very small data range so that the gamma adjustment of the voltage for a grayscale of 0-255 is very difficult and it is difficult for a gamma operational amplifier to ensure that 256 grayscales are provided within a range of 0.5V. Therefore, the conventional pixel circuit cannot satisfy its application to a silicon-based substrate. However, in the display panel provided in this embodiment, the multivoltage supply circuit 30 is provided so that the voltage of the control terminal N1 of the drive circuit 213 is increased by ΔV. Therefore, the data range of the pixel circuit in this embodiment is widened, for example, may be adjusted within a range of 1.5, which satisfies the easy gamma adjustment of a grayscale of 0-255.

It is to be noted that in the initialization stage, the first light-emission control circuit 215 and the data writing circuit 212 may or may not be turned on. If the first light-emission control circuit 215 and the data writing circuit 212 are turned on, the voltage transmitted by the data writing circuit 212 is VP+.

Figure 10:
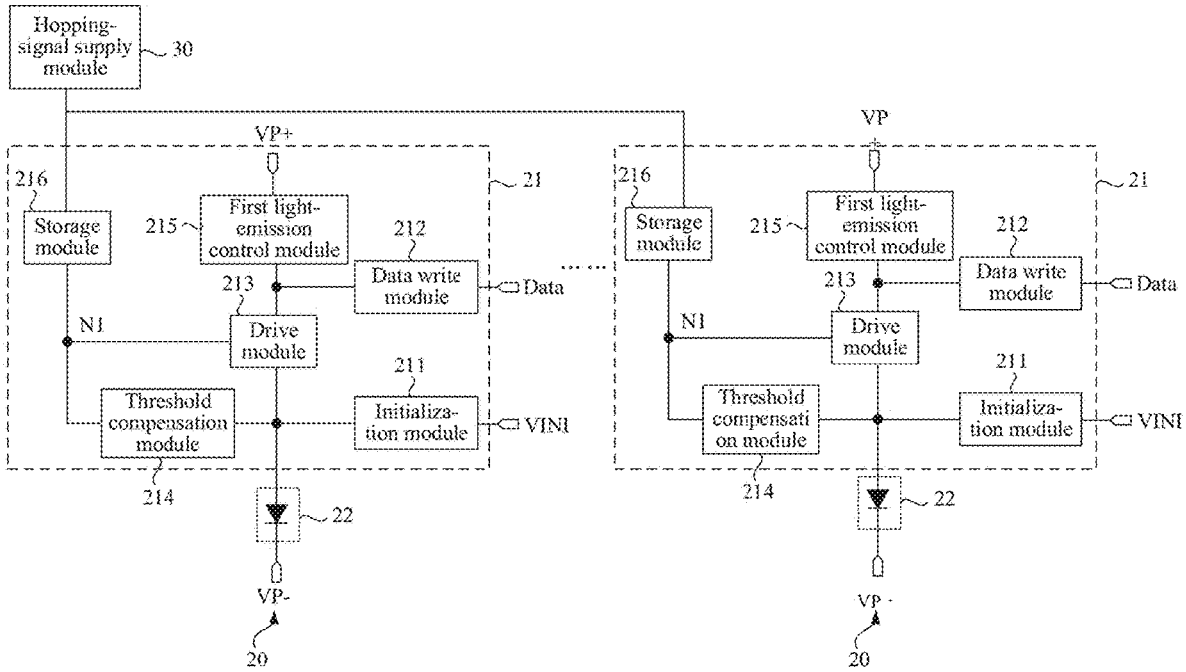
FIG. 10 is a structure diagram of another display panel according to an embodiment of the present disclosure.

Optionally, FIG. 10 is a structure diagram of another display panel according to an embodiment of the present disclosure. As shown in FIG. 10, first terminals of storage circuits 216 of sub-pixels 20 in each row are electrically connected to the same multivoltage supply circuit 30.

For example, the first terminals of the storage circuits 216 of the sub-pixels 20 in each row are electrically connected to the same multivoltage supply circuit 30, that is, one multivoltage supply circuit 30 supplies the reset signal $V_{ref}$ to the first terminals of the storage circuits 216 in different sub-pixels 20 in the same row in the initialization stage and the first stage and supplies the first power signal VP+ to the first terminals of the storage circuits 216 in the different sub-pixels 20 in the same row in the second stage, which reduces the number of multivoltage supply circuits 30, simplifies the steps for manufacturing the display panel, and improves the manufacturing efficiency of the display panel. Additionally, it can be ensured that the first terminals of the storage circuits 216 in the sub-pixels 20 in one row receive the reset signal $V_{ref}$ or the first power signal VP+ synchronously.

Figure 11:
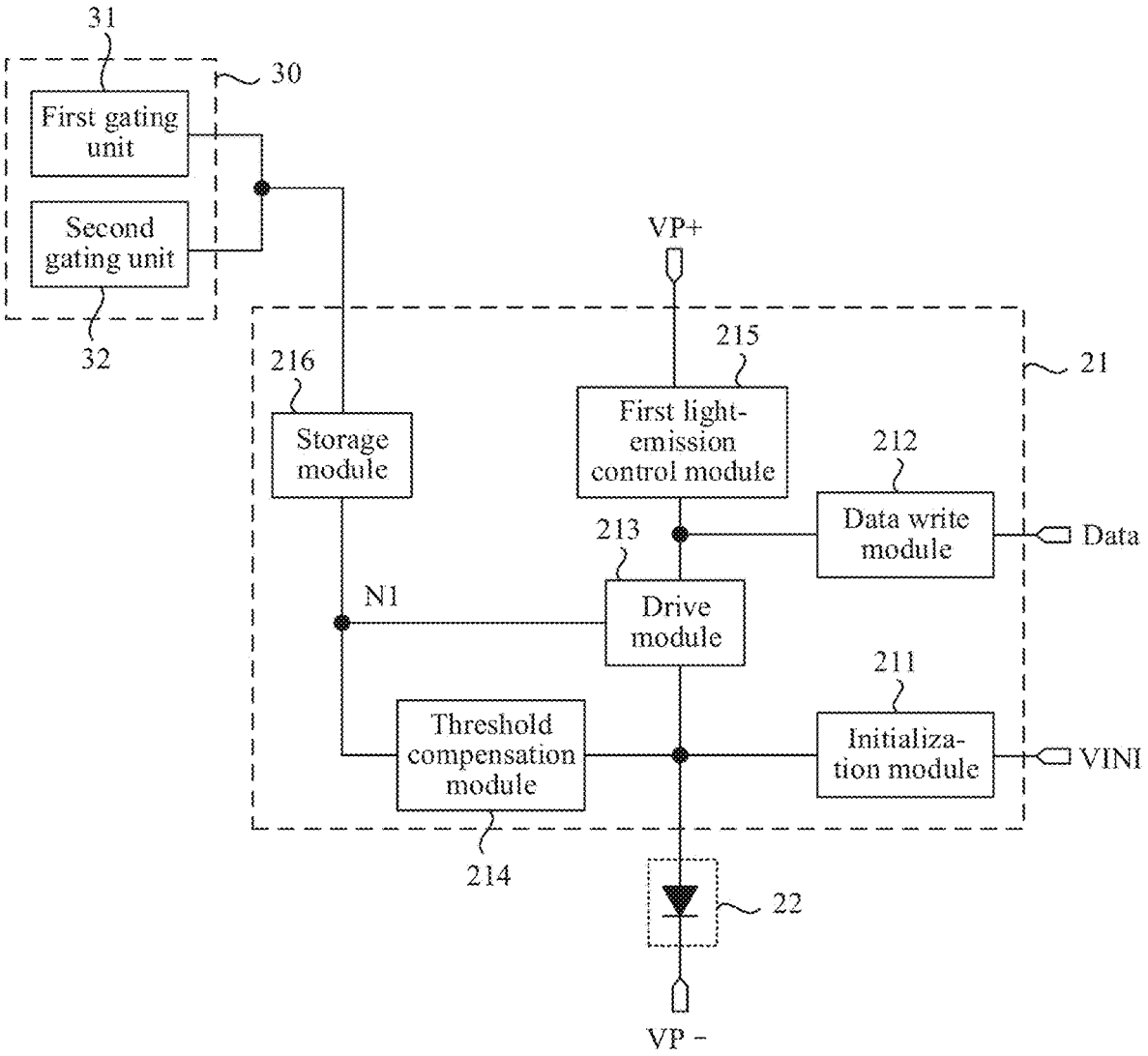
FIG. 11 is a partial structure diagram of another display panel according to an embodiment of the present disclosure.

Optionally, FIG. 11 is a partial structure diagram of another display panel according to an embodiment of the present disclosure. As shown in FIG. 11, the multivoltage supply circuit 30 includes a first gating unit 31 and a second gating unit 32. The first gating unit 31 is configured to supply the reset signal $V_{ref}$ to the first terminal of the storage circuit 216 in the initialization stage and the first stage. The second gating unit 32 is configured to supply the first power signal VP+ to the first terminal of the storage circuit 216 in the second stage. That is to say, the reset signal $V_{ref}$ and the first power signal VP+ are supplied to the first terminal of the storage circuit 216 by different gating units, respectively.

Figure 12:
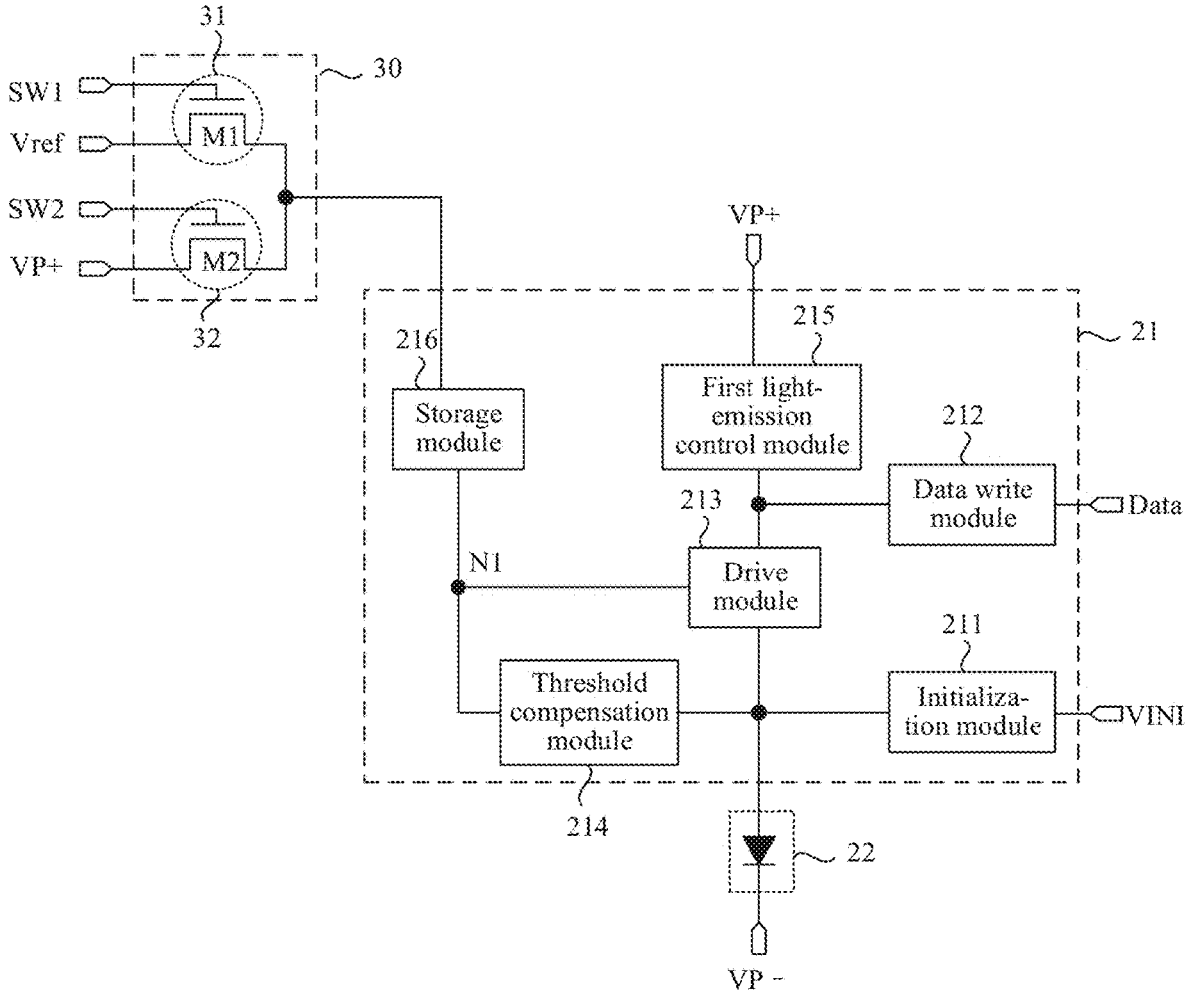
FIG. 12 is a partial structure diagram of another display panel according to an embodiment of the present disclosure.

Optionally, FIG. 12 is a partial structure diagram of another display panel according to an embodiment of the present disclosure. As shown in FIG. 12, the first gating unit 31 includes a first transistor M1 and the second gating unit 32 includes a second transistor M2; where a second electrode of the first transistor M1 and a second electrode of the second transistor M2 are electrically connected to the first terminal of the storage circuit 216; a first electrode of the first transistor M1 is configured to receive the reset signal $V_{ref}$, and a first electrode of the second transistor M2 is configured to receive the first power signal VP+; a gate of the first transistor M1 is configured to receive a first control signal SW1 and be turned on in the initialization stage and the first stage according to the first control signal SW1; and a gate of the second transistor M2 is configured to receive a second control signal SW2 and be turned on in the second stage according to the second control signal SW2.

The first control signal SW1 controls the first transistor M1 to be turned on or off so as to control whether to transmit the reset signal $V_{ref}$ to the first terminal of the storage circuit 216. The second control signal SW2 controls the second transistor M2 to be turned on or off so as to control whether to transmit the first power signal VP+ to the first terminal of the storage circuit 216. The first control signal SW1 and the second control signal SW2 are a pair of reverse control signals, that is, the second transistor M2 is turned off when the first transistor M1 is turned on; or the second transistor M2 is turned on when the first transistor M1 is turned off.

Figure 13:
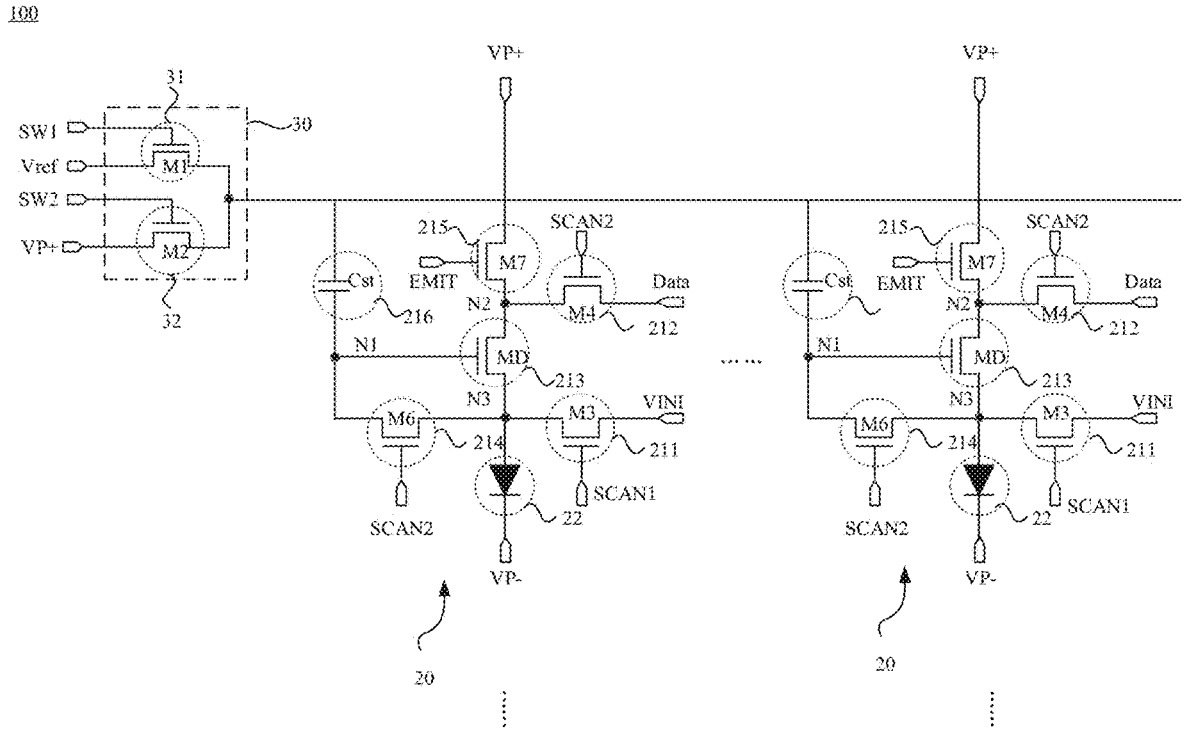
FIG. 13 is a structure diagram of another display panel according to an embodiment of the present disclosure.

Optionally, FIG. 13 is a structure diagram of another display panel according to an embodiment of the present disclosure. As shown in FIG. 13, the initialization circuit 211 includes a third transistor M3, the data writing circuit 212 includes a fourth transistor M4, the drive circuit 213 includes a fifth transistor MD, the threshold compensation circuit 214 includes a sixth transistor M6, the first light-emission control circuit 215 includes a seventh transistor M7, and the storage circuit 216 includes a capacitor Cst; where a first electrode of the third transistor M3 is electrically connected to the initialization signal terminal VINI, a second electrode of the third transistor M3 is electrically connected to the anode of the light-emitting element 22, and a gate of the third transistor M3 is electrically connected to a first scan signal terminal SCAN1; a first electrode of the fourth transistor M4 is electrically connected to the data signal terminal Data, a second electrode of the fourth transistor M4 is electrically connected to a first electrode of the fifth transistor MD, and a gate of the fourth transistor M4 is electrically connected to a second scan signal terminal SCAN2; a second electrode of the fifth transistor MD is electrically connected to the anode of the light-emitting element 22; a first electrode of the sixth transistor M6 is electrically connected to the anode of the light-emitting element 22, a second electrode of the sixth transistor M6 is electrically connected to a gate of the fifth transistor MD, and a gate of the sixth transistor M6 is electrically connected to the second scan signal terminal SCAN2; and a first electrode of the seventh transistor M7 is electrically connected to a first power signal terminal VP+, a second electrode of the seventh transistor M7 is electrically connected to the first electrode of the fifth transistor MD, and a gate of the seventh transistor M7 is electrically connected to a light-emission control terminal EMIT.

It is to be noted that in FIG. 13, each circuit includes one transistor, that is, the pixel circuit 21 provided in this embodiment is a 5T1C (five transistors and one storage capacitor) circuit. However, the pixel circuit 21 is not limited to such a pixel circuit arrangement as long as a pixel can be driven.

Each transistor may be the PMOS transistor or an n-type metal-oxide-semiconductor (NMOS) transistor, which is not limited in the embodiments of the present disclosure. The working principles of the multivoltage supply circuit 30 and the pixel circuit 21 are described below in detail by using an example in which the pixel circuit 21 is the 5T1C (five transistors and one storage capacitor) circuit and the transistors and the gating units are all PMOS transistors.

Figure 14:
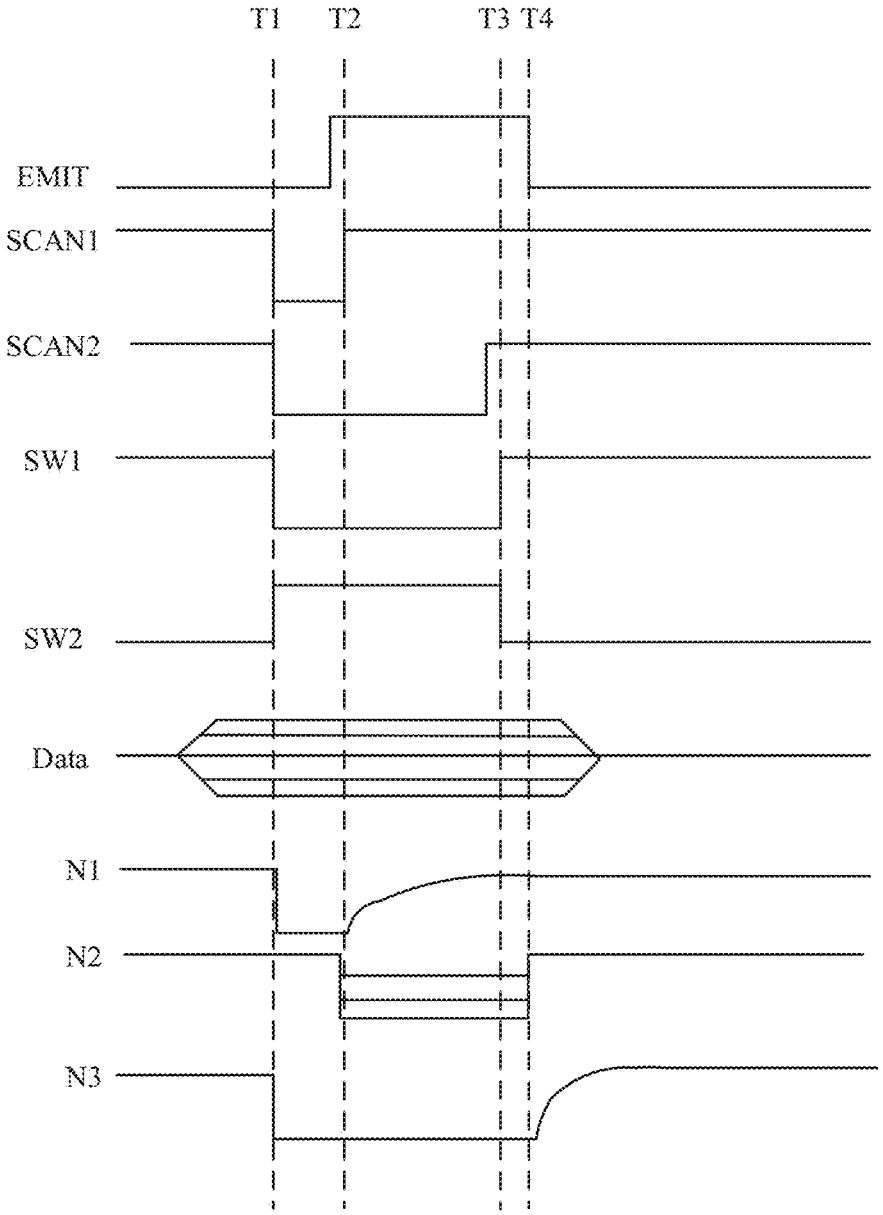
FIG. 14 is a timing diagram of a pixel circuit and a multivoltage supply circuit according to an embodiment of the present disclosure.

FIG. 14 is a timing diagram of a pixel circuit and a multivoltage supply circuit according to an embodiment of the present disclosure. As shown in FIG. 14, in a time period from T1 to T2, that is, in the initialization stage, the first control signal SW1 acquired by the gate of the first transistor M1, a light-emission control signal Emit acquired by the gate of the seventh transistor M7, the second scan signal SCAN2 acquired by the gate of the fourth transistor M4 and the gate of the sixth transistor M6 and the first scan signal SCAN1 acquired by the gate of the third transistor M3 are all at low levels. At this time, the first transistor M1, the seventh transistor M7, the fourth transistor M4, the sixth transistor M6 and the third transistor M3 are turned on. The initialization signal $V_{ini}$ from the initialization signal terminal VINI is written into the anode of the light-emitting element 22 through the third transistor M3 to initialize the anode of the light-emitting element 22, and the initialization signal $V_{ini}$ is supplied to the gate of the fifth transistor MD through the sixth transistor M6 to initialize the fifth transistor MD. In this case, the potential of the gate of the fifth transistor MD is $V_{ini}+V_{th}$, that is, the potential of the second plate of the capacitor Cst is $V_{ini}+V_{th}$. At the same time, the first transistor M1 writes the reset signal $V_{ref}$ into the first plate of the capacitor Cst. In this case, a voltage difference between two plates of the capacitor Cst is $V_{ref}-(V_{ini}+V_{th})$.

In a time period from T2 to T3, that is, in the first stage, the first control signal SW1 acquired by the gate of the first transistor M1 and the second scan signal SCAN2 acquired by the gate of the fourth transistor M4 and the gate of the sixth transistor M6 are all at low levels, and the light-emission control signal Emit acquired by the gate of the seventh transistor M7, the first scan signal SCAN1 acquired by the gate of the third transistor M3 and the second control signal SW2 acquired by the gate of the second transistor M2 are all at high levels. At this time, the first transistor M1, the fourth transistor M4 and the sixth transistor M6 are turned on, and the second transistor M2, the seventh transistor M7 and the third transistor M3 are turned off. The data signal $V_{data}$ transmitted by the data signal terminal Data is written into the gate of the fifth transistor MD through the fourth transistor M4, the fifth transistor MD and the sixth transistor M6 so that the voltage of the gate of the fifth transistor MD gradually increases until a difference between the voltage of the gate of the fifth transistor MD and a voltage of the first electrode of the fifth transistor MD is the threshold voltage $V_{th}$ of the fifth transistor MD. At this time, the fifth transistor MD is turned off, and the voltage of the gate N1 of the fifth transistor MD is $V1=V_{data}-V_{th}$, that is, the potential of the second plate of the capacitor Cst is $V_{data}-V_{th}$. At the same time, the first transistor M1 writes the reset signal $V_{ref}$ into the first plate of the capacitor Cst. In this case, the voltage difference between the two plates of the capacitor Cst is $V_{ref}-(V_{data}-V_{th})$.

In a time period from T3 to T4, that is, in the second stage, the first control signal SW1 acquired by the gate of the first transistor M1, the light-emission control signal Emit acquired by the gate of the seventh transistor M7, the second scan signal SCAN2 acquired by the gate of the fourth transistor M4 and the gate of the sixth transistor M6 and the first scan signal SCAN1 acquired by the gate of the third transistor M3 are all at high levels. At this time, the first transistor M1, the seventh transistor M7, the fourth transistor M4, the sixth transistor M6 and the third transistor M3 are turned off. The second control signal SW2 acquired by the gate of the second transistor M2 is at a low level, the second transistor M2 is turned on, and the first power signal VP+ is written into the first plate of the capacitor Cst through the second transistor M2 so that the potential of the first plate of the capacitor Cst jumps from the reset signal $V_{ref}$ to the first power signal VP+, that is, the voltage jump ΔV is generated, where $\Delta V=(VP+)-V_{ref}$. The potential of the gate N1 of the fifth transistor MD then jumps a voltage of ΔV, that is, the final potential of the gate N1 of the fifth transistor MD is $(VP+)-V_{ref}+V_{data}-V_{th}$.

In a time period after T4, that is, in the light emission stage, the first control signal SW1 acquired by the gate of the first transistor M1, the second scan signal SCAN2 acquired by the gate of the fourth transistor M4 and the gate of the sixth transistor M6 and the first scan signal SCAN1 acquired by the gate of the third transistor M3 are all at high levels. At this time, the first transistor M1, the fourth transistor M4, the sixth transistor M6 and the third transistor M3 are turned off. The light-emission control signal Emit acquired by the gate of the seventh transistor M7 and the second control signal SW2 acquired by the gate of the second transistor M2 are both at low levels, the seventh transistor M7 and the second transistor M2 are turned on, and the voltage of the first electrode N2 of the fifth transistor MD is VP+. In this case, the voltage difference between the first electrode N2 and the gate N1 of the fifth transistor MD is $V3=(VP+)-((VP+)-V_{ref}+V_{data}-V_{th})=V_{ref}-V_{data}+V_{th}$. In this case, the fifth transistor MD generates the drive current which flows into the light-emitting element 22 and drives the light-emitting element 22 to emit light. In this case, in Formula (1) of the drive current, $|V_{GS}-V_{th}|=V_{ref}-V_{data}+V_{th}-V_{th}=V_{ref}-V_{data}$. It can be seen that the drive current $I_{MD}$ generated by the fifth transistor MD is independent of the threshold voltage $V_{th}$ of the fifth transistor MD and VP+, that is, the display panel in this embodiment not only has the function of compensating the threshold voltage but also can avoid the effect of the voltage drop, resulting in more uniform display. Additionally, the first transistor M1 and the second transistor M2 are provided so that the voltage of the gate N1 of the fifth transistor MD varies. Therefore, to enable the light-emitting element 22 to maintain the original brightness, the larger voltage needs to be inputted so that compared with an existing sub-pixel, a data range of the sub-pixel expands and a voltage for a grayscale of 0-255 of the sub-pixel can be easily adjusted.

It is to be noted that to reduce the number of signal lines, a control terminal of the fourth transistor M4 and a control terminal of the sixth transistor M6 receive the same signal. However, in the initialization stage, the initialization signal $V_{ini}$ needs to be supplied to the gate of the fifth transistor MD through the sixth transistor M6, during which the fourth transistor M4 is turned on. To prevent the data signal from being written in this stage, the signal transmitted by the data signal terminal Data is VP+.

Based on the preceding solution, optionally, the gate of the first transistor M1 and the second scan signal terminal SCAN2 are both configured to receive the first control signal SW1. Such a setting has the following advantage: the gate of the first transistor M1 and the second scan signal terminal SCAN2 acquire the same signal, that is, are connected to the same signal line, so that the structure is simple.

Figure 15:
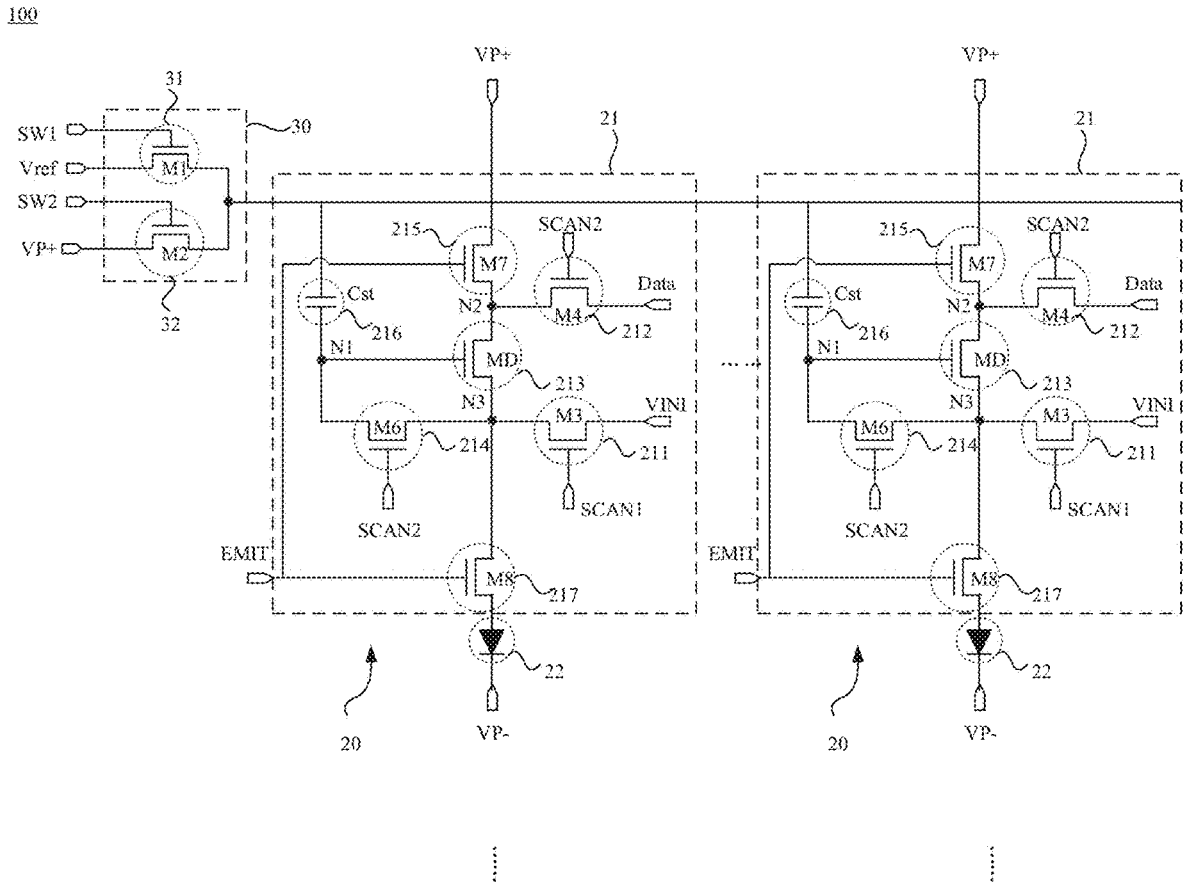
FIG. 15 is a structure diagram of another display panel according to an embodiment of the present disclosure.

Optionally, FIG. 15 is a structure diagram of another display panel according to an embodiment of the present disclosure. As shown in FIG. 15, the drive circuit 213, the threshold compensation circuit 214 and the initialization circuit 211 are connected to a first node N3; and the pixel circuit 21 further includes a second light-emission control circuit 217 disposed between the anode of the light-emitting element 22 and the first node N3.

In this embodiment, the second light-emission control circuit 217 is provided so that in the data writing stage, the pixel circuit 21 is disconnected from the light-emitting element 22. In this case, there is no current flowing into the light-emitting element 22, and the drive circuit 213 only charges its control terminal N1. During charging, the light-emitting element 22 does not emit light, reducing power consumption and improving the display contrast of the display panel 100.

Optionally, with continued reference to FIG. 15, the first light-emission control circuit 215, the data writing circuit 212 and the drive circuit 213 are connected to a second node N2; and the first light-emission control circuit 215 includes a seventh transistor M7 and the second light-emission control circuit 217 includes an eighth transistor M8; where a first electrode of the seventh transistor M7 is electrically connected to the first power signal terminal VP+ and a second electrode of the seventh transistor M7 is electrically connected to the second node N2; and a first electrode of the eighth transistor M8 is electrically connected to the first node N3, a second electrode of the eighth transistor M8 is electrically connected to the anode of the light-emitting element 22, and a gate of the eighth transistor M8 and a gate of the seventh transistor M7 are electrically connected to the same light-emission control terminal. In this embodiment, both the first light-emission control circuit 215 and the second light-emission control circuit 217 are transistors, and the gates of the transistors are connected to the same light-emission control terminal so that there is no need to provide respective light-emission control signal lines for the seventh transistor M7 and the eighth transistor M8, which reduces wires, simplifies the structure, improves the manufacturing efficiency of the display panel, and is conducive to reducing the number of control terminals on a chip for driving the pixel circuit 21 and saving a cost of the chip.

Figure 16:
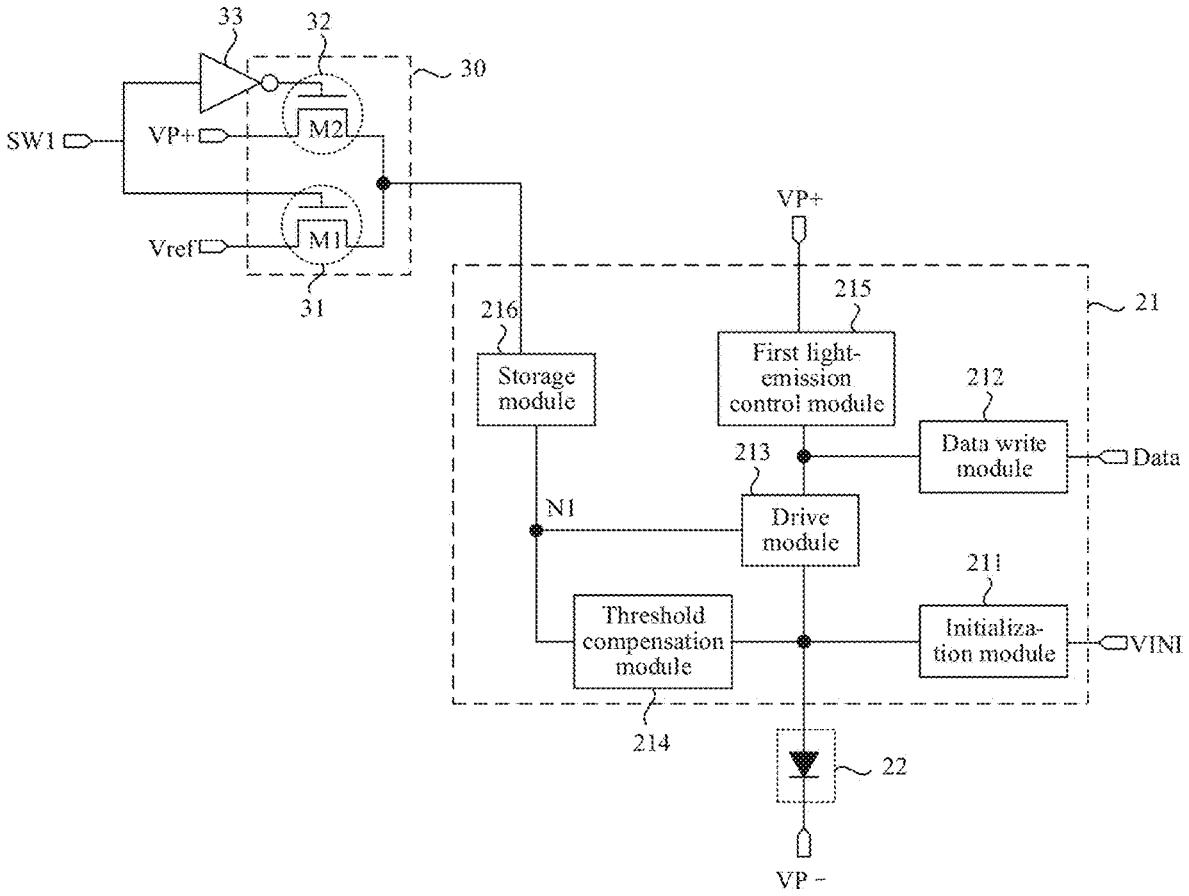
FIG. 16 is a partial structure diagram of another display panel according to an embodiment of the present disclosure.

Optionally, FIG. 16 is a partial structure diagram of another display panel according to an embodiment of the present disclosure. As shown in FIG. 16, the multivoltage supply circuit 30 further includes a phase inverter 33; where an input terminal of the phase inverter 33 and the gate of the first transistor M1 are configured to receive the first control signal SW1, and an output terminal of the phase inverter 33 is electrically connected to the gate of the second transistor M2.

In this embodiment, the phase inverter 33 is provided so that only one control signal line needs to be provided in the display panel to provide one control signal SW1 to control the first transistor M1 and the second transistor M2 and there is no need to provide respective control signal lines for the first transistor M1 and the second transistor M2, which reduces wires, simplifies the structure, improves the manufacturing efficiency of the display panel, and is conducive to reducing the number of control terminals on the chip for driving the pixel circuit 21 and saving the cost of the chip.

Figure 17:
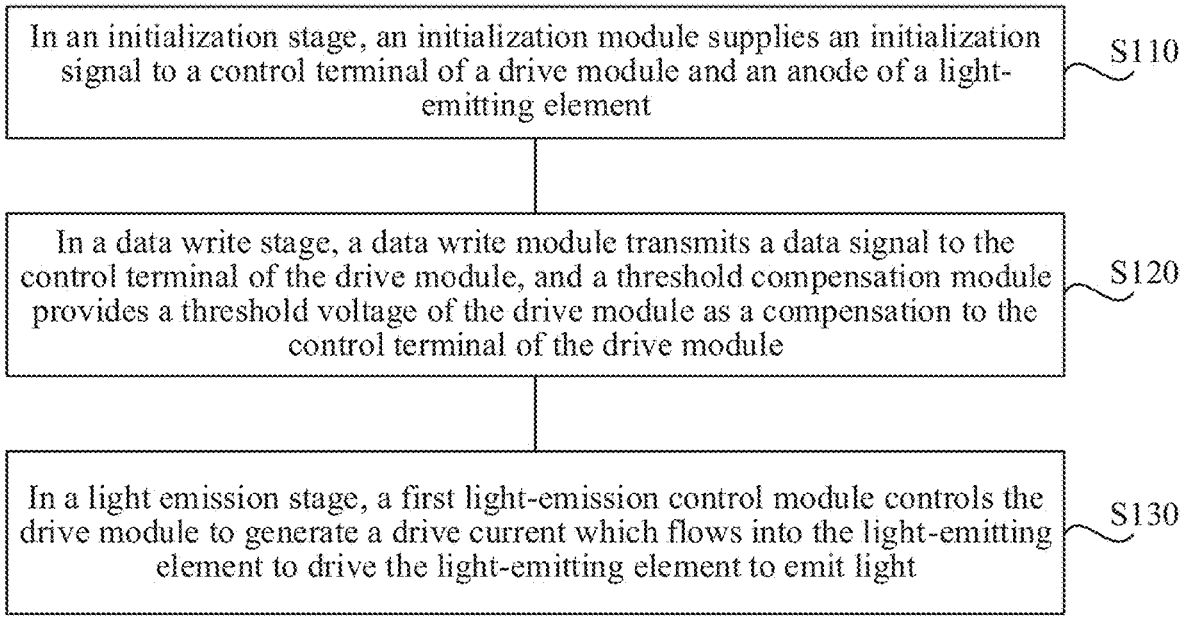
FIG. 17 is a flowchart of a method for driving a display panel according to an embodiment of the present disclosure.

Based on the same inventive concept, an embodiment of the present disclosure provides a method for driving a display panel. The method for driving a display panel is applied to the display panel in the embodiments described above. FIG. 17 is a flowchart of a method for driving a display panel according to an embodiment of the present disclosure. As shown in FIG. 17, the method for driving a display panel includes steps described below.

In S110, in an initialization stage, an initialization circuit supplies an initialization signal to a control terminal of a drive circuit and an anode of a light-emitting element.

In S120, in a data writing stage, a data writing circuit transmits a data signal to the control terminal of the drive circuit, and a threshold compensation circuit provides a threshold voltage of the drive circuit as a compensation to the control terminal of the drive circuit.

In S130, in a light emission stage, a first light-emission control circuit controls the drive circuit to generate a drive current which flows into the light-emitting element to drive the light-emitting element to emit light.

For example, the method for driving a display panel provided by the embodiment of the present disclosure is applied to the display panel shown in FIG. 4. As shown in FIG. 5, in the initialization stage, the initialization circuit 211 and the threshold compensation circuit 214 are on, and the initialization circuit 211 supplies the initialization signal $V_{ini}$ to the anode of the light-emitting element 22 to initialize a potential of the anode of the light-emitting element 22, so as to reduce an effect of a voltage of the anode of the light-emitting element 22 in a previous frame on a voltage of the anode of the light-emitting element 22 in a current frame and improve display uniformity; and the initialization circuit 211 provides the initialization signal $V_{ini}$ to the control terminal N1 of the drive circuit 213 through the threshold compensation circuit 214 to initialize the drive circuit 213, so as to avoid an effect of a data signal for light emission and display in the previous frame on a potential of the control terminal N1 of the drive circuit 213 in the current frame and prevent the display effect of the current frame from being affected. That is, the anode of the light-emitting element 22 and the control terminal N1 of the drive circuit 213 can be initialized by the initialization circuit 211, which is simple in structure.

In the data writing stage, the data writing circuit 212 and the threshold compensation circuit 214 are turned on, and the data signal $V_{data}$ supplied by the data writing circuit 212 can be written into the control terminal N1 of the drive circuit 213 through the data writing circuit 212 and the threshold compensation circuit 214 so that the voltage of the control terminal N1 of the drive circuit 213 gradually increases until a difference between the voltage of the control terminal N1 of the drive circuit 213 and a voltage of a first terminal of the drive circuit 213 is equal to the threshold voltage $V_{th}$ of the drive circuit 213. At this time, the drive circuit 213 is off, and the voltage of the control terminal N1 of the drive circuit 213 is $V1=V_{data}-V_{th}$, where $V_{th}$ denotes the threshold voltage of the drive circuit. In this case, a voltage difference Vc between two terminals of the storage circuit 216 is $Vc=V0-V2=V0-(V_{data}-V_{th})$, where V0 denotes a potential of a first terminal of the storage circuit 216 and may be, for example, a fixed potential, and V2 denotes a potential of a second terminal of the storage circuit 216. That is, in the data writing stage, the threshold voltage $V_{th}$ of the drive circuit 213 is detected and stored on the storage circuit 216 so that threshold compensation is performed on the drive circuit 213. Therefore, in the light emission stage, the drive current supplied by the drive circuit 213 to the light-emitting element 22 can drive the light-emitting element 22 to stably emit light.

Figure 18:
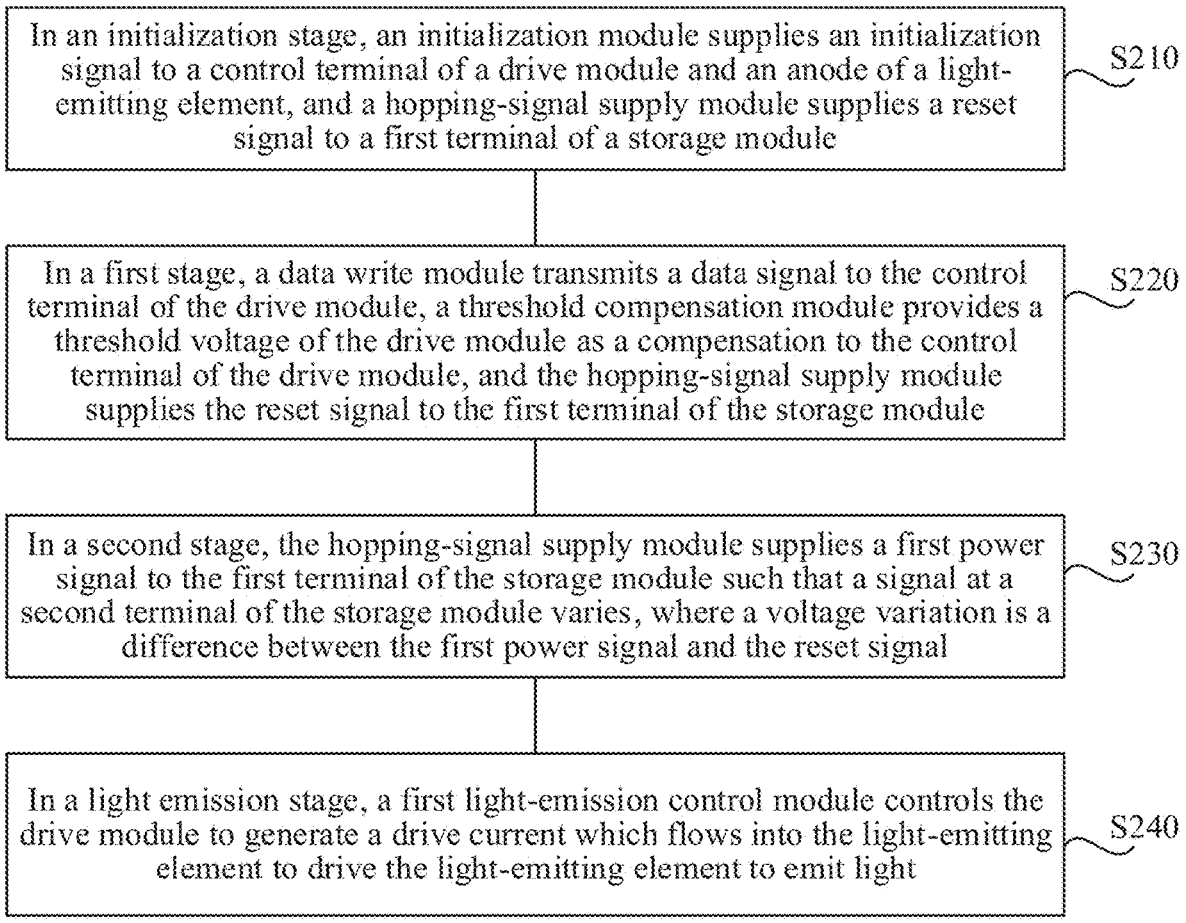
FIG. 18 is a flowchart of another method for driving a display panel according to an embodiment of the present disclosure.

Optionally, the display panel further includes at least one multivoltage supply circuit. In this case, the data writing stage includes a first stage and a second stage. FIG. 18 is a flowchart of another method for driving a display panel according to an embodiment of the present disclosure. As shown in FIG. 18, the method for driving a display panel includes steps described below.

In S210, in the initialization stage, the initialization circuit supplies the initialization signal to the control terminal of the drive circuit and the anode of the light-emitting element, and the multivoltage supply circuit supplies a reset signal to the first terminal of the storage circuit.

In S220, at the first stage, the data writing circuit transmits the data signal to the control terminal of the drive circuit, the threshold compensation circuit provides the threshold voltage of the drive circuit as a compensation to the control terminal of the drive circuit, and the multivoltage supply circuit supplies the reset signal to the first terminal of the storage circuit.

In S230, in the second stage, the multivoltage supply circuit supplies a first power signal to the first terminal of the storage circuit such that a signal at the second terminal of the storage circuit varies, where a voltage variation is a difference between the first power signal and the reset signal.

In S240, in the light emission stage, the first light-emission control circuit controls the drive circuit to generate the drive current which flows into the light-emitting element to drive the light-emitting element to emit light.

For example, the method for driving a display panel provided by the embodiment of the present disclosure is applied to the display panel shown in FIG. 8. Referring to FIG. 8, in the initialization stage, the initialization circuit 211 and the threshold compensation circuit 214 are on, and the initialization circuit 211 supplies the initialization signal $V_{ini}$ to the anode of the light-emitting element 22; and the initialization circuit 211 supplies the initialization signal $V_{ini}$ to the control terminal N1 of the drive circuit 213 through the threshold compensation circuit 214 to initialize the drive circuit 213. In this case, the potential of the control terminal N1 of the drive circuit 213 is $V_{ini}+V_{th}$, that is, the potential of the second terminal of the storage circuit 216 is $V_{ini}$ $V_{th}$. Meanwhile, the multivoltage supply circuit 30 provides the reset signal $V_{ref}$ to the first terminal of the storage circuit 216. In this case, the voltage difference between the two terminals of the storage circuit 216 is $V_{ref}-(V_{ini}+V_{th})$.

In the first stage, the data writing circuit 212 and the threshold compensation circuit 214 are on, and the data signal $V_{data}$ supplied by the data writing circuit 212 can be written into the control terminal N1 of the drive circuit 213 through the data writing circuit 212 and the threshold compensation circuit 214 so that the voltage of the control terminal N1 of the drive circuit 213 gradually increases until the difference between the voltage of the control terminal N1 of the drive circuit 213 and the voltage of the first terminal of the drive circuit 213 is equal to the threshold voltage $V_{th}$ of the drive circuit 213. At this time, the drive circuit 213 is off, and the voltage of the control terminal N1 of the drive circuit 213 is $V1=V_{data}-V_{th}$, that is, the potential of the second terminal of the storage circuit 216 is $V_{data}$ $V_{th}$. Meanwhile, the multivoltage supply circuit 30 provides the reset signal $V_{ref}$ to the first terminal of the storage circuit 216. In this case, the voltage difference between the two terminals of the storage circuit 216 is $V_{ref}-(V_{data}-V_{th})$.

In the second stage, the initialization circuit 211, the data writing circuit 212, the threshold compensation circuit 214 and the first light-emission control circuit 215 are all off. The multivoltage supply circuit 30 supplies the first power signal VP+ to the first terminal of the storage circuit 216 so that the potential of the first terminal of the storage circuit 216 jumps from the reset signal $V_{ref}$ to the first power signal VP+, that is, a voltage jump ΔV is generated, where $\Delta V=(VP+)-V_{ref}$. Since a capacitor has the characteristic of charge conservation, the second terminal of the storage circuit 216 also generates the voltage jump ΔV, that is, the control terminal N1 of the drive circuit 213 generates the voltage jump ΔV. The final potential of the control terminal N1 of the drive circuit 213 is $(VP+)-V_{ref}+V_{data}-V_{th}$.

In the light emission stage, the first light-emission control circuit 215 is on and transmits the first power signal VP+ to one terminal of the drive circuit 213. At this time, the voltage difference between the first terminal and the control terminal N1 of the drive circuit 213 is $V3=(VP+)-((VP+)-V_{ref}+V_{data}-V_{th})=V_{ref}-V_{data}+V_{th}$, and the drive circuit 213 generates the drive current which flows into the light-emitting element 22 and drives the light-emitting element 22 to emit light. In this case, in Formula (1) of the drive current, $|V_{GS}-V_{th}|=V_{ref}-V_{data}+V_{th}-V_{th}=V_{ref}-V_{data}$. It can be seen that the drive current $I_{MD}$ generated by the drive circuit 213 is independent of the threshold voltage $V_{th}$ of the drive circuit 213 and VP+, that is, the display panel in this embodiment not only has the function of compensating the threshold voltage but also can avoid an effect of a voltage drop, resulting in more uniform display. Additionally, the multivoltage supply circuit is provided so that the voltage of the control terminal N1 of the drive circuit varies. Therefore, to enable the light-emitting element 22 to maintain the original brightness, a larger voltage needs to be inputted so that compared with an existing sub-pixel, a data range of the sub-pixel expands and a voltage for a grayscale of 0-255 of the sub-pixel can be clearly adjusted.

Figure 19:
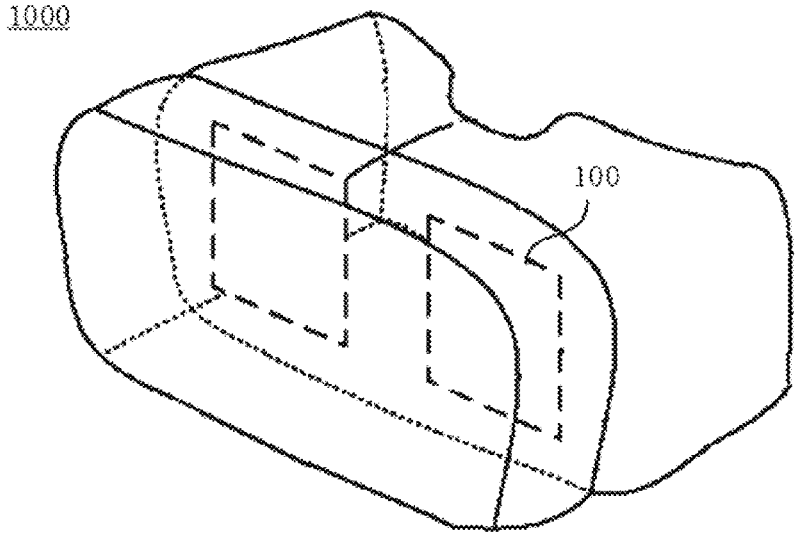
FIG. 19 is a structure diagram of a display device according to an embodiment of the present disclosure.

Based on the same inventive concept, an embodiment of the present disclosure further provides a display device. FIG. 19 is a structure diagram of a display device according to an embodiment of the present disclosure. As shown in FIG. 19, a display device 1000 includes the display panel 1001 in the preceding embodiments. Therefore, the display device 1000 provided by the embodiment of the present disclosure also has the beneficial effects described in the preceding embodiments, and details are not repeated here. For example, the display device 1000 may be an augmented reality (AR) display device, a virtual reality (VR) display device or an electronic display device such as a mobile phone, a computer or a television.

It is to be noted that the preceding are only preferred embodiments of the present disclosure and technical principles used therein. It is to be understood by those skilled in the art that the present disclosure is not limited to the embodiments described herein. Those skilled in the art can make various apparent modifications, adaptations and substitutions without departing from the scope of the present disclosure. Therefore, while the present disclosure has been described in detail through the preceding embodiments, the present disclosure is not limited to the preceding embodiments and may include more other equivalent embodiments without departing from the concept of the present disclosure. The scope of the present disclosure is determined by the scope of the appended claims.

What is claimed is:

1. A display panel, comprising:

a substrate;

a plurality of sub-pixels on a side of the substrate, wherein each of the plurality of sub-pixels comprises a pixel circuit and a light-emitting element; and the pixel circuit comprises an initialization circuit, a data writing circuit, a drive circuit, a threshold compensation circuit, a first light-emission control circuit and a storage circuit; and a plurality of multivoltage supply circuits; wherein a first terminal of the storage circuit is electrically connected to a corresponding one of the multivoltage supply circuits and a second terminal of the storage circuit is electrically connected to a control terminal of the drive circuit;

the initialization circuit is configured to supply an initialization signal to the control terminal of the drive circuit through the threshold compensation circuit and supply the initialization signal to an anode of the light-emitting element in an initialization stage;

the data writing circuit is configured to transmit a data signal to the control terminal of the drive circuit in a data writing stage, wherein the data writing stage comprises a first stage and a second stage;

the threshold compensation circuit is configured to provide a threshold voltage of the drive circuit as a compensation to the control terminal of the drive circuit;

the storage circuit is configured to store the data signal transmitted to the control terminal of the drive circuit;

the first light-emission control circuit is configured to: in a light emission stage, control, according to a light-emission control signal inputted, the drive circuit to generate a drive current which flows into the light-emitting element to drive the light-emitting element to emit light; and each of the multivoltage supply circuits is configured to supply a reset signal to the first terminal of the storage circuit in the initialization stage and the first stage and supply a first power signal to the first terminal of the storage circuit in the second stage such that a signal at the second terminal of the storage circuit varies, wherein a voltage variation is a difference between the first power signal and the reset signal; wherein first terminals of storage circuits of sub-pixels in each row are electrically connected to a corresponding one of the multivoltage supply circuits;

each of the multivoltage supply circuits comprises a first gating unit and a second gating unit; wherein the first gating unit is configured to supply the reset signal to the first terminals of the storage circuits of sub-pixels in a corresponding row in the initialization stage and the first stage; and the second gating unit is configured to supply the first power signal to the first terminals of the storage circuits of sub-pixels in a corresponding row in the second stage; and the first gating unit comprises a first transistor and the second gating unit comprises a second transistor; wherein a second electrode of the first transistor and a second electrode of the second transistor are electrically connected to the first terminals of the storage circuits of sub-pixels in a corresponding row; a first electrode of the first transistor is configured to receive the reset signal, and a first electrode of the second transistor is configured to receive the first power signal; a gate of the first transistor is configured to receive a first control signal and be on in the initialization stage and the first stage according to the first control signal; and a gate of the second transistor is configured to receive a second control signal and be on in the second stage according to the second control signal.

2. The display panel of claim 1, wherein the substrate comprises a silicon-based substrate.

3. The display panel of claim 1, wherein the each of the multivoltage supply circuits further comprises a phase inverter; wherein an input terminal of the phase inverter and the gate of the first transistor are configured to receive the first control signal, and an output terminal of the phase inverter is electrically connected to the gate of the second transistor.

4. The display panel of claim 1, wherein the initialization circuit comprises a third transistor, the data writing circuit comprises a fourth transistor, the drive circuit comprises a fifth transistor, the threshold compensation circuit comprises a sixth transistor, the first light-emission control circuit comprises a seventh transistor, and the storage circuit comprises a capacitor; wherein a first electrode of the third transistor is electrically connected to an initialization signal terminal, a second electrode of the third transistor is electrically connected to the anode of the light-emitting element, and a gate of the third transistor is electrically connected to a first scan signal terminal;

a first electrode of the fourth transistor is electrically connected to a data signal terminal, a second electrode of the fourth transistor is electrically connected to a first electrode of the fifth transistor, and a gate of the fourth transistor is electrically connected to a second scan signal terminal;

a second electrode of the fifth transistor is electrically connected to the anode of the light-emitting element;

a first electrode of the sixth transistor is electrically connected to the anode of the light-emitting element, a second electrode of the sixth transistor is electrically connected to a gate of the fifth transistor, and a gate of the sixth transistor is electrically connected to the second scan signal terminal; and a first electrode of the seventh transistor is electrically connected to a first power signal terminal, a second electrode of the seventh transistor is electrically connected to the first electrode of the fifth transistor, and a gate of the seventh transistor is electrically connected to a light-emission control terminal.

5. The display panel of claim 4, wherein the gate of the first transistor and the second scan signal terminal are configured to receive the first control signal.

6. The display panel of claim 1, wherein the drive circuit, the threshold compensation circuit and the initialization circuit are connected to a first node; and the pixel circuit further comprises a second light-emission control circuit between the anode of the light-emitting element and the first node.

7. The display panel of claim 6, wherein the first light-emission control circuit, the data writing circuit and the drive circuit are connected to a second node; and the first light-emission control circuit comprises a seventh transistor and the second light-emission control circuit comprises an eighth transistor; wherein a first electrode of the seventh transistor is electrically connected to a first power signal terminal and a second electrode of the seventh transistor is electrically connected to the second node; and a first electrode of the eighth transistor is electrically connected to the first node, a second electrode of the eighth transistor is electrically connected to the anode of the light-emitting element, and a gate of the eighth transistor and a gate of the seventh transistor are electrically connected to a same light-emission control terminal.

8. A method for driving a display panel, comprising:

in an initialization stage, supplying, by an initialization circuit, an initialization signal to a control terminal of a drive circuit and an anode of a light-emitting element, and supplying, by a first transistor, a reset signal to first terminals of storage circuits of sub-pixels in a same row;

in a first stage, transmitting, by a data writing circuit, a data signal to the control terminal of the drive circuit, providing, by a threshold compensation circuit, a threshold voltage of the drive circuit as a compensation to the control terminal of the drive circuit, and supplying, by the first transistor, the reset signal to first terminals of storage circuits of sub-pixels in a same row;

in a second stage, supplying, by a second transistor, a first power signal to first terminals of storage circuits of sub-pixels in a same row such that a signal at a second terminal of each of the storage circuits of the sub-pixels in the same row varies, wherein a voltage variation is a difference between the first power signal and the reset signal; and in a light emission stage, controlling, by a first light-emission control circuit, the drive circuit to generate a drive current which flows into the light-emitting element to drive the light-emitting element to emit light; wherein the display panel comprises:

a substrate;

a plurality of sub-pixels on a side of the substrate, wherein each of the plurality of sub-pixels comprises a pixel circuit and the light-emitting element; and the pixel circuit comprises the initialization circuit, the data writing circuit, the drive circuit, the threshold compensation circuit, the first light-emission control circuit and the storage circuit; and a plurality of multivoltage supply circuits; wherein a first terminal of the storage circuit is electrically connected to a corresponding one of the multivoltage supply circuits and a second terminal of the storage circuit is electrically connected to the control terminal of the drive circuit;

the initialization circuit is configured to supply the initialization signal to the control terminal of the drive circuit through the threshold compensation circuit and supply the initialization signal to the anode of the light-emitting element in the initialization stage;

the data writing circuit is configured to transmit the data signal to the control terminal of the drive circuit in a data writing stage, wherein the data writing stage comprises the first stage and the second stage;

the threshold compensation circuit is configured to provide the threshold voltage of the drive circuit as the compensation to the control terminal of the drive circuit;

the storage circuit is configured to store the data signal transmitted to the control terminal of the drive circuit;

the first light-emission control circuit is configured to: in the light emission stage, control according to a light-emission control signal inputted, the drive circuit to generate the drive current which flows into the light-emitting element to drive the light-emitting element to emit light; and each of the multivoltage supply circuits is configured to supply the reset signal to the first terminal of the storage circuit in the initialization stage and the first stage and supply the first power signal to the first terminal of the storage circuit in the second stage such that the signal at the second terminal of the storage circuit varies, wherein the voltage variation is the difference between the first power signal and the reset signal;

first terminals of storage circuits of sub-pixels in each row are electrically connected to a corresponding one of the multivoltage supply circuits;

each of the multivoltage supply circuits comprises a first gating unit and a second gating unit; wherein the first gating unit is configured to supply the reset signal to the first terminals of the storage circuits of sub-pixels in a corresponding row in the initialization stage and the first stage; and the second gating unit is configured to supply the first power signal to the first terminals of the storage circuits of sub-pixels in a corresponding row in the second stage; and the first gating unit comprises the first transistor and the second gating unit comprises the second transistor; wherein a second electrode of the first transistor and a second electrode of the second transistor are electrically connected to the first terminals of the storage circuits of sub-pixels in a corresponding row; a first electrode of the first transistor is configured to receive the reset signal, and a first electrode of the second transistor is configured to receive the first power signal; a gate of the first transistor is configured to receive a first control signal and be on in the initialization stage and the first stage according to the first control signal; and a gate of the second transistor is configured to receive a second control signal and be on in the second stage according to the second control signal.

9. The method of claim 8, wherein the substrate comprises a silicon-based substrate.

10. The method of claim 8, wherein the each of the multivoltage supply circuits further comprises a phase inverter; wherein an input terminal of the phase inverter and the gate of the first transistor are configured to receive the first control signal, and an output terminal of the phase inverter is electrically connected to the gate of the second transistor.

11. The method of claim 8, wherein the initialization circuit comprises a third transistor, the data writing circuit comprises a fourth transistor, the drive circuit comprises a fifth transistor, the threshold compensation circuit comprises a sixth transistor, the first light-emission control circuit comprises a seventh transistor, and the storage circuit comprises a capacitor; wherein a first electrode of the third transistor is electrically connected to an initialization signal terminal, a second electrode of the third transistor is electrically connected to the anode of the light-emitting element, and a gate of the third transistor is electrically connected to a first scan signal terminal;

a first electrode of the fourth transistor is electrically connected to a data signal terminal, a second electrode of the fourth transistor is electrically connected to a first electrode of the fifth transistor, and a gate of the fourth transistor is electrically connected to a second scan signal terminal;

a second electrode of the fifth transistor is electrically connected to the anode of the light-emitting element;

a first electrode of the sixth transistor is electrically connected to the anode of the light-emitting element, a second electrode of the sixth transistor is electrically connected to a gate of the fifth transistor, and a gate of the sixth transistor is electrically connected to the second scan signal terminal; and a first electrode of the seventh transistor is electrically connected to a first power signal terminal, a second electrode of the seventh transistor is electrically connected to the first electrode of the fifth transistor, and a gate of the seventh transistor is electrically connected to a light-emission control terminal.

12. The method of claim 11, wherein the gate of the first transistor and the second scan signal terminal are configured to receive the first control signal.

13. The method of claim 8, wherein the drive circuit, the threshold compensation circuit and the initialization circuit are connected to a first node; and the pixel circuit further comprises a second light-emission control circuit between the anode of the light-emitting element and the first node.

14. The method of claim 13, wherein the first light-emission control circuit, the data writing circuit and the drive circuit are connected to a second node; and the first light-emission control circuit comprises a seventh transistor and the second light-emission control circuit comprises an eighth transistor; wherein a first electrode of the seventh transistor is electrically connected to a first power signal terminal and a second electrode of the seventh transistor is electrically connected to the second node; and a first electrode of the eighth transistor is electrically connected to the first node, a second electrode of the eighth transistor is electrically connected to the anode of the light-emitting element, and a gate of the eighth transistor and a gate of the seventh transistor are electrically connected to a same light-emission control terminal.

15. A display device, comprising a display panel, wherein the display panel comprises:

a substrate;

a plurality of sub-pixels on a side of the substrate, wherein each of the plurality of sub-pixels comprises a pixel circuit and a light-emitting element; and the pixel circuit comprises an initialization circuit, a data writing circuit, a drive circuit, a threshold compensation circuit, a first light-emission control circuit and a storage circuit; and a plurality of multivoltage supply circuits; wherein a first terminal of the storage circuit is electrically connected to a corresponding one of the multivoltage supply circuits and a second terminal of the storage circuit is electrically connected to a control terminal of the drive circuit;

the initialization circuit is configured to supply an initialization signal to the control terminal of the drive circuit through the threshold compensation circuit and supply the initialization signal to an anode of the light-emitting element in an initialization stage;

the data writing circuit is configured to transmit a data signal to the control terminal of the drive circuit in a data writing stage, wherein the data writing stage comprises a first stage and a second stage;

the threshold compensation circuit is configured to provide a threshold voltage of the drive circuit as a compensation to the control terminal of the drive circuit;

the storage circuit is configured to store the data signal transmitted to the control terminal of the drive circuit;

the first light-emission control circuit is configured to: in a light emission stage, control according to a light-emission control signal inputted, the drive circuit to generate a drive current which flows into the light-emitting element to drive the light-emitting element to emit light; and each of the multivoltage supply circuits is configured to supply a reset signal to the first terminal of the storage circuit in the initialization stage and the first stage and supply a first power signal to the first terminal of the storage circuit in the second stage such that a signal at the second terminal of the storage circuit varies, wherein a voltage variation is a difference between the first power signal and the reset signal; wherein first terminals of storage circuits of sub-pixels in each row are electrically connected to a corresponding one of the multivoltage supply circuits;

each of the multivoltage supply circuits comprises a first gating unit and a second gating unit; wherein the first gating unit is configured to supply the reset signal to the first terminals of the storage circuits of sub-pixels in a corresponding row in the initialization stage and the first stage; and the second gating unit is configured to supply the first power signal to the first terminals of the storage circuits of sub-pixels in a corresponding row in the second stage; and the first gating unit comprises a first transistor and the second gating unit comprises a second transistor; wherein a second electrode of the first transistor and a second electrode of the second transistor are electrically connected to the first terminals of the storage circuits of sub-pixels in a corresponding row; a first electrode of the first transistor is configured to receive the reset signal, and a first electrode of the second transistor is configured to receive the first power signal; a gate of the first transistor is configured to receive a first control signal and be on in the initialization stage and the first stage according to the first control signal; and a gate of the second transistor is configured to receive a second control signal and be on in the second stage according to the second control signal.

16. The display device of claim 15, wherein the each of the multivoltage supply circuits further comprises a phase inverter; wherein an input terminal of the phase inverter and the gate of the first transistor are configured to receive the first control signal, and an output terminal of the phase inverter is electrically connected to the gate of the second transistor.

17. The display device of claim 15, wherein the initialization circuit comprises a third transistor, the data writing circuit comprises a fourth transistor, the drive circuit comprises a fifth transistor, the threshold compensation circuit comprises a sixth transistor, the first light-emission control circuit comprises a seventh transistor, and the storage circuit comprises a capacitor; wherein a first electrode of the third transistor is electrically connected to an initialization signal terminal, a second electrode of the third transistor is electrically connected to the anode of the light-emitting element, and a gate of the third transistor is electrically connected to a first scan signal terminal;

a first electrode of the fourth transistor is electrically connected to a data signal terminal, a second electrode of the fourth transistor is electrically connected to a first electrode of the fifth transistor, and a gate of the fourth transistor is electrically connected to a second scan signal terminal;

a second electrode of the fifth transistor is electrically connected to the anode of the light-emitting element;

a first electrode of the sixth transistor is electrically connected to the anode of the light-emitting element, a second electrode of the sixth transistor is electrically connected to a gate of the fifth transistor, and a gate of the sixth transistor is electrically connected to the second scan signal terminal; and a first electrode of the seventh transistor is electrically connected to a first power signal terminal, a second electrode of the seventh transistor is electrically connected to the first electrode of the fifth transistor, and a gate of the seventh transistor is electrically connected to a light-emission control terminal.

18. The display device of claim 17, wherein the gate of the first transistor and the second scan signal terminal are configured to receive the first control signal.

19. The display device of claim 15, wherein the drive circuit, the threshold compensation circuit and the initialization circuit are connected to a first node; and the pixel circuit further comprises a second light-emission control circuit between the anode of the light-emitting element and the first node.

20. The display device of claim 19, wherein the first light-emission control circuit, the data writing circuit and the drive circuit are connected to a second node; and the first light-emission control circuit comprises a seventh transistor and the second light-emission control circuit comprises an eighth transistor; wherein a first electrode of the seventh transistor is electrically connected to a first power signal terminal and a second electrode of the seventh transistor is electrically connected to the second node; and a first electrode of the eighth transistor is electrically connected to the first node, a second electrode of the eighth transistor is electrically connected to the anode of the light-emitting element, and a gate of the eighth transistor and a gate of the seventh transistor are electrically connected to a same light-emission control terminal.

* * * * *